US006583760B2

(12) United States Patent
Martek et al.

(10) Patent No.: US 6,583,760 B2
(45) Date of Patent: Jun. 24, 2003

(54) DUAL MODE SWITCHED BEAM ANTENNA

(75) Inventors: Gary A. Martek, Edgewood, WA (US); Blaine J. Smith, Tacoma, WA (US)

(73) Assignee: Metawave Communications Corporation, Redmond, WA (US)

( * ) Notice: Subject to any disclaimer, the term of this patent is extended or adjusted under 35 U.S.C. 154(b) by 0 days.

(21) Appl. No.: 09/938,259

(22) Filed: Aug. 23, 2001

(65) Prior Publication Data

US 2002/0021246 A1 Feb. 21, 2002

Related U.S. Application Data

(63) Continuation-in-part of application No. 09/798,151, filed on Mar. 2, 2001, now abandoned, which is a continuation of application No. 09/213,640, filed on Dec. 17, 1998, now Pat. No. 6,198,434.

(51) Int. Cl.[7] ..... H01Q 3/22; H01Q 3/24; H01Q 3/26

(52) U.S. Cl. ..... 342/373; 343/820; 343/813; 343/814; 343/816

(58) Field of Search ..... 342/373; 343/820, 343/813, 814, 816

(56) References Cited

U.S. PATENT DOCUMENTS

| | | | | |
|---|---|---|---|---|
| 4,231,040 A | | 10/1980 | Walker | |
| 4,973,971 A | | 11/1990 | Sinsky et al. | |
| 5,086,302 A | | 2/1992 | Miller | |
| 5,343,211 A | | 8/1994 | Kott | |
| 5,589,843 A | | 12/1996 | Meredith et al. | |
| 5,612,702 A | * | 3/1997 | Kinsey | 342/427 |
| 5,774,090 A | | 6/1998 | Marcy et al. | |
| 5,825,762 A | | 10/1998 | Kamin, Jr. et al. | |
| 5,929,823 A | | 7/1999 | Martek et al. | |
| 6,178,333 B1 | | 1/2001 | Feuerstein et al. | |
| 6,188,373 B1 | | 2/2001 | Martek | |
| 6,198,434 B1 | | 3/2001 | Martek et al. | |
| 6,211,841 B1 | | 4/2001 | Smith et al. | |
| 6,295,035 B1 | * | 9/2001 | Holzheimer | 343/792.5 |

OTHER PUBLICATIONS

"A Dual–Band Dual–Polarized Array for Spaceborne SAR", David M. Pozar, et al., IEEE (1998) pp. 2112–2115.

"An L/X Dual–Band Dual–Polarized Shared–Aperture Array for Spaceborne SAR", Stephen D. Targonski, et al., IEEE (1999).

"Dual–Frequency and Dual–Polarization Microstrip Antennas for SAR Applications", Ralph Pokuls, et al, IEEE (1998), pp. 1289–1296.

Herscovici, Naftali. "New Considerations in the Design of Microstrip Antennas." IEEE Transactions on Antennas and Propagation, vol. 46, No. 6. (Jun. 1998) pp. 807–812.

U.S. patent application Ser. No. 09/798,151, Martek.

* cited by examiner

*Primary Examiner*—Theodore M. Blum
(74) *Attorney, Agent, or Firm*—Fulbright & Jaworski LLP

(57) ABSTRACT

Systems and methods for providing antenna beams having reduced grating and side lobes when steered off of the antenna broadside are disclosed. According to the present invention an arrangement of antenna elements suitable for use in generating antenna beams steered at greater angles off of the antenna broadside is utilized with a beam feed network consistent with the antenna beams being steered at the greater angles and reduced antenna element spacing to provide the reduced grating and side lobes. A preferred embodiment utilizes a $2^{n+1}$ Butler matrix coupled to $2^{n+1}$ antenna columns spaced according to the present invention to provide $2^n$ antenna beams. Preferred embodiments provide a dual mode antenna system in which antenna elements of a first mode are interspersed with antenna elements of a second mode.

72 Claims, 9 Drawing Sheets

--- BEAM 4 x 4, 90° BW, 0 ROTATION
—— BEAM 8 x 4, 90° BW, 0 ROTATION

--- BEAM 4 x 4, 112° BW, 30 ROTATION
—— BEAM 8 x 4, 107° BW, 30 ROTATION

DUAL MODE SWITCHED BEAM ANTENNA

RELATED APPLICATIONS

The present application is a continuation-in-part of copending and commonly assigned U.S. patent application Ser. No. 09/798,151 entitled "Dual Mode Switched Beam Antenna," filed Mar. 2, 2001, now abandoned, which itself is a continuation of commonly assigned U.S. patent application Ser. No. 09/213,640, new U.S. Pat. No. 6,198,434 entitled "Dual Mode Switched Beam Antenna," filed Dec. 17, 1998, the disclosures of which are hereby incorporated herein by reference. The present application is also related to copending and commonly assigned U.S. patent application Ser. No. 09/034,471, new U.S. Pat. No. 6,188,373 entitled "System and Method for Per Beam Elevation Scanning," filed Mar. 4, 1998, copending and commonly assigned U.S. patent application Ser. No. 08/896,036, new U.S. Pat. No. 5,929,823 entitled "Multiple Beam Planar Array With Parasitic Elements," filed Jul. 17, 1997, and copending and commonly assigned U.S. patent application Ser. No. 09/060,921, new U.S. Pat. No. 6,178,333 entitled "System and Method Providing Delays for CDMA Nulling," filed Apr. 15, 1998, the disclosures of which are hereby incorporated herein by reference.

TECHNICAL FIELD

This invention relates to antenna systems, and, more particularly, to the providing of an antenna adapted for operation in multiple bands.

BACKGROUND

It is common to use a single antenna array to provide a radiation pattern, or beam, which is steerable. For example, steerable beams are often produced by a planar or panel array of antenna elements each excited by a signal having a predetermined phase differential so as to produce a composite radiation pattern having a predefined shape and direction. In order to steer this composite beam, the phase differential between the antenna elements is adjusted to affect the composite radiation pattern.

A multiple beam antenna array may be created, utilizing a planar or panel array described above, for example, through the use of predetermined sets of phase differentials, where each set of phase differential defines a beam of the multiple beam antenna. For example, an array adapted to provide multiple selectable antenna beams, each of which is steered a different predetermined amount from the broadside, may be provided using a panel array and matrix type beam forming networks, such as a Butler or hybrid matrix.

When a planar array is excited uniformly (uniform aperture distribution) to produce a broadsided beam projection, the composite aperture distribution resembles a rectangular shape. When this shape is Fourier transformed in space, the resultant pattern is laden with high level side lobes relative to the main lobe. Moreover, as the beam steering increases, i.e., the beam is directed further away from the broadside, these side lobes grow to higher levels. For example, a linear array with its beam-peak at $\Theta_0$, can also have other peak values subject to the choice of element spacing "d". This ambiguity is apparent, since the summation also has a peak whenever the exponent is some multiple of $2\pi$. At frequency "f" and wavelength lambda, this condition is $$2\pi\left(\frac{d}{\lambda}\right)(\sin\Theta_{scan} - \sin\Theta_0) = 2\pi p$$

for all integers p. Such peaks are called grating lobes and are shown from the above equation to occur at angles $\Theta_p$ such that $\sin\Theta_p = \sin\Theta_0 = 2\pi p$. Accordingly, when the radiation pattern is steered too far relative to the element spacing a grating lobe will appear which can have a peak in its pattern nearly equal to the main lobe of the radiation pattern. The point at which this occurs is generally considered the maximum useful steering angle of the array.

Even when steering of the main beam is restricted to angles such that the grating lobe presents a peak appreciably less than that of the main lobe, the presence of the grating lobe acts to degrade the performance of the antenna system by making it responsive to signals in an undesired direction, potentially interfering with the desired signal. Specifically, as the main beam is steered off of the broadside of the array, the grating lobe will often be directed at an angle within the range of angles the antenna array is operable within. Accordingly, the presence of a stray communication beam having a substantial peak associated therewith and present within the area of operation of the antenna array will very often be a source of interference. Moreover, as the grating lobe is substantially coaxial with the axis of radiation of the antenna panel, it is generally not possible to avoid this interference with solutions such as tilting the array to point the grating lobe in a harmless direction.

Additionally, broadside excitation of a planar array yields maximum aperture projection. Accordingly, when such an antenna is made to come off the normal axis, i.e., steered away from the broadside position which is normal to the ground surface and centered to the surface itself, the projected aperture area decreases causing a scan loss. This scan loss further aggravates the problems associated with the grating lobes because not only is the aperture area of the steered beam decreased due to the effects of scan loss, but the unwanted grating lobes are simultaneously increased due to the effects of beam steering.

It is sometimes desirable to utilize a particular antenna aperture for communication of multiple services and/or frequency bands. For example, zoning restrictions and other concerns may limit communication service providers ability to deploy separate antenna systems for use with various communication services, such as standard cellular telephony services and personal communication services (PCS). Accordingly, it may be desirable to provide a single antenna system to service multiple such services.

However, it should be appreciated that each such service may utilize a substantially different frequency bands, e.g., the aforementioned standard cellular systems may operate at approximately 800 MHz whereas PCS systems may operate at approximately 1.8 GHz. Therefore, undesirable antenna attributes, such as the aforementioned grating lobes, may be experienced to differing degrees in association with each of the multiple services, making design and implementation of a single antenna aperture for use with multiple services challenging.

Accordingly, a need exists in the art for a system and method of providing antenna beams having a desired beam widths and azimuthal orientations without suffering from the presence of grating lobes when steered a desired amount off of the broadside.

Moreover, as multiple beam antenna arrays are useful in providing wireless communication networks, such as standard cellular services and/or personal communication services (PCS) networks (referred to hereinafter collectively as cellular networks), which are often simultaneously provided in a same service area, a need exists in the art for the systems and methods adapted to provide desired antenna beams substantially free of grating lobes to also be adapted for dual mode service.

SUMMARY OF THE INVENTION

These and other objects, features and technical advantages are achieved by an antenna array, such as a multiple beam antenna system including a beam forming matrix, wherein only the inner most beams of those possible from the array are utilized and the pertinent antenna element column or row spacing is adjusted to achieve the desired antenna beam shapes, i.e., beam widths, and sector pattern. The radiation pattern resulting from the use of such an antenna, whether relying on restricted beam switching of a multiple beam array or restricted scanning of an adaptive array, utilizing only the inner beams has the desired characteristic of avoiding the grating lobes associated with the outer most antenna beams, or other antenna beams steered substantially from the broad side, of an array.

An antenna array for providing desired communications may use four beams, i.e., a panel having four antenna columns provides four 30° substantially non-overlapping antenna beams which when composited provide a 120° sector. The beam forming matrix for such an array may be a 4×4 Butler matrix, a matrix having inputs and outputs limited to powers of two (inputs/outputs=2, wherein n=2 for the 4×4 matrix), providing the signals of four antenna beam interfaces in a phased progression at each of the four antenna columns. These beams may be referred to as, from left to right viewing the antenna array from the broadside, 2R, 1R, 1L, 2L, with the beams steered at the most acute angle off of the broadside, beams 2R and 2L, having substantial grating lobes associated therewith.

A preferred embodiment of the present invention utilizes an antenna capable of providing antenna beams steered further off of the broad side than those relied upon for providing communication. For example, a preferred embodiment utilizes a beam forming matrix having $2^{n+1}$ inputs for forming $2^n$ antenna beams. Accordingly, in the above example where four ($2^2$) beams are desired, a beam forming matrix having eight ($2^3$) inputs and outputs is utilized. In order to provide the desired beams without the presence of grating lobes while still providing tolerable side lobe levels, and a desirable main beam, the antenna array fed by the beam forming matrix of this embodiment of the present invention has a number of antenna columns corresponding to the n+1 inputs. Therefore, the eight outputs of the beam forming matrix are each coupled to one of eight antenna columns of an antenna array and is thus capable of providing eight antenna beams (4R, 3R, 2R, 1R, 1L, 2R, 3R, and 4R).

According to the present invention, although the antenna array may be capable of forming a number of beams in excess of those desired, only the inner beams are used. For example, in the preferred embodiment described above only the 2R, 1R, 1L, and 2R beams are used out of an available combination of 4R, 3R, 2R, 1R, 1L, 2L, 3L, and 4L beams. These inner most beams typically have better radiation characteristics than the outer most beams and therefore do not present the grating lobes it is a purpose of the present invention to avoid.

However, it should be appreciated that the characteristics of the individual antenna beams of the above described array of the present invention will not substantially conform to those of the antenna array it is intended to replace. For example, rather than providing four approximately 30° antenna beams which define a 1200 sector, the 2R, 1R, 1L, and 2R beams as of the 8×8 beam forming matrix used according to the present invention may provide four approximately 150 antenna beams which define a 60° sector because of the increased number of antenna columns energized in the phase progression.

Accordingly, the present invention, includes adjustment of the antenna column and/or row spacing to re-point the used beams in the desired direction although the phase progression utilized for a more narrow beam eight beam array are maintained. Moreover, as the inter column spacing is adjusted to re-point the beams at desired angles from the broadside, so too are the antenna beam widths adjusted to desired widths. Accordingly, the above described preferred embodiment antenna array having an 8×8 beam forming matrix may be utilized to provide four substantially 30° beams defining a 1200 sector.

The respacing of antenna elements according to the present invention results in the closing in the elemental spacing which has the desirable effect of reducing or even suppressing any grating lobes that may have been present in the original array configuration. It should be appreciated that the respacing of antenna elements, by closing in the elemental spacing, of the preferred embodiment may result in undesirable effects associated with the phenomena of mutual coupling. Accordingly, preferred embodiments of the invention use techniques to over come adverse effects of mutual coupling associated with antenna elements being placed in close proximity to one another.

For example, embodiments of the present invention employ the use of "stagger" tuning. Additionally or alternatively, embodiments of the present invention employ the use of electrically grounded partitions, referred to herein as "Faraday fences". These two very different techniques may be used according to preferred embodiments of the present invention to over come the effects of mutual coupling between the radiating elements making up the antenna array which can distort individual element patterns that are components in the process of beam forming. For example, either or both of the above techniques can be used for mitigation of direct space coupling. Faraday fences may be used along row and/or column spacings of an array to provide isolation between adjacent elements while providing for the use of a uniform feed system, such as may be particularly desirable for a mass-produced antenna product by minimizing the need for different parts.

Further, the use of a Butler matrix as well as individual element, column, and/or row impedance matching can be used to minimize coupling associated with the feed network that interconnects elements in the array. Keeping the installation of the antenna away from blocking structure, such as an associated support tower, may be utilized in minimizing indirect coupling occurring by scattering from nearby objects.

Elemental spacing according to the present invention may be adjusted to affect the best possible compromise between independent modes, such as advanced mobile phone services (AMPS) and code division multiple access (CDMA) communication signals, that may be using the array simultaneously. Additionally or alternatively, embodiments of the present invention provide a first group of antenna elements, preferably having the above described reduced spacing, for use with a first communication service or frequency band, and a second group of antenna elements, also preferably having the above described reduced spacing and interspersed with the first group of antenna elements, for use with a second communication service or frequency band. Accordingly, the geometry of each such group of antenna elements may be tuned for the respective communication service or frequency band used therewith. This interspersed element dual band configuration provides an antenna system having a single antenna aperture for multiple communication services which may be substantially the same size as that of a single communication service antenna array.

Preferably, the antenna elements of each such group of interspersed antenna elements are disposed in a same plane. For example, the antenna elements of each such group may be disposed in a plane parallel to and a quarter of the low band (e.g., first frequency band) mid-frequency wavelength above a ground plane. However, the antenna elements of each antenna element groups are preferably disposed a quarter of their respective band mid-frequency wavelength above a ground plane. Accordingly, a preferred embodiment of the present invention provides adaptation of the antenna ground plane to present a ground plane surface, such as a raised fin corresponding to antenna elements of the second group of antenna elements, a quarter of the respective band mid-frequency wavelength behind each antenna element to thereby allow each antenna element to be disposed in the same elemental array plane while providing the desired ground plane relationship with respect to elements of each communication service or frequency.

Preferred embodiments of the interspersed element dual band antenna array include antenna elements in addition to those directly used in the desired improved beam forming. For example, the interspersing of antenna elements of the different groups of antenna elements may affect communication using one or the other antenna element groups, such as by resulting in a non-uniform radiating environment. Specifically, the antenna elements of one group of the antenna elements present somewhat parasitic radiating structures with respect to antenna elements of another group of antenna elements of the above embodiment. Accordingly, antenna elements of inner columns of a group of antenna elements may be presented an appreciably different radiating environment than antenna elements of outer columns of a group of antenna elements. Accordingly, a preferred embodiment array of the present invention provides additional antenna elements disposed to provide a quasi-uniform radiating environment as seen by the active antenna elements. According to a preferred embodiment of the invention, these additional elements may be utilized in various ways in addition to providing a uniform radiating environment, such as to provide antennae for use in an opposite link direction with respect to the aforementioned grouped antenna elements.

Although described above with respect to an antenna array utilizing a beam forming matrix having a number of inputs associated with multiple antenna beams, an alternative embodiment of the present invention utilizes an adaptive beam forming matrix in combination with the array having additional columns and respaced antenna elements in order to provide a steerable antenna beam which, when steered significantly off broadside, has little or no grating lobe associated therewith. Such an embodiment preferably relies upon a feed network dynamically providing a phase progression across the antenna columns rather than the fixed phase progression of the above mentioned Butler and hybrid beam forming matrixes. Accordingly, it should be appreciated that the phase progression provided by this adaptive feed network is consistent with that of the more narrow beams of the larger array, although utilized to provide a lesser number of improved beams according to the present invention.

A technical advantage of the present invention is to use a phased array antenna to provide multiple or steerable antenna beams with reduced or no grating lobes.

A further technical advantage of the present invention is to provide an antenna which is optimized for use in communicating multiple communication modes simultaneously.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

Figure 1:
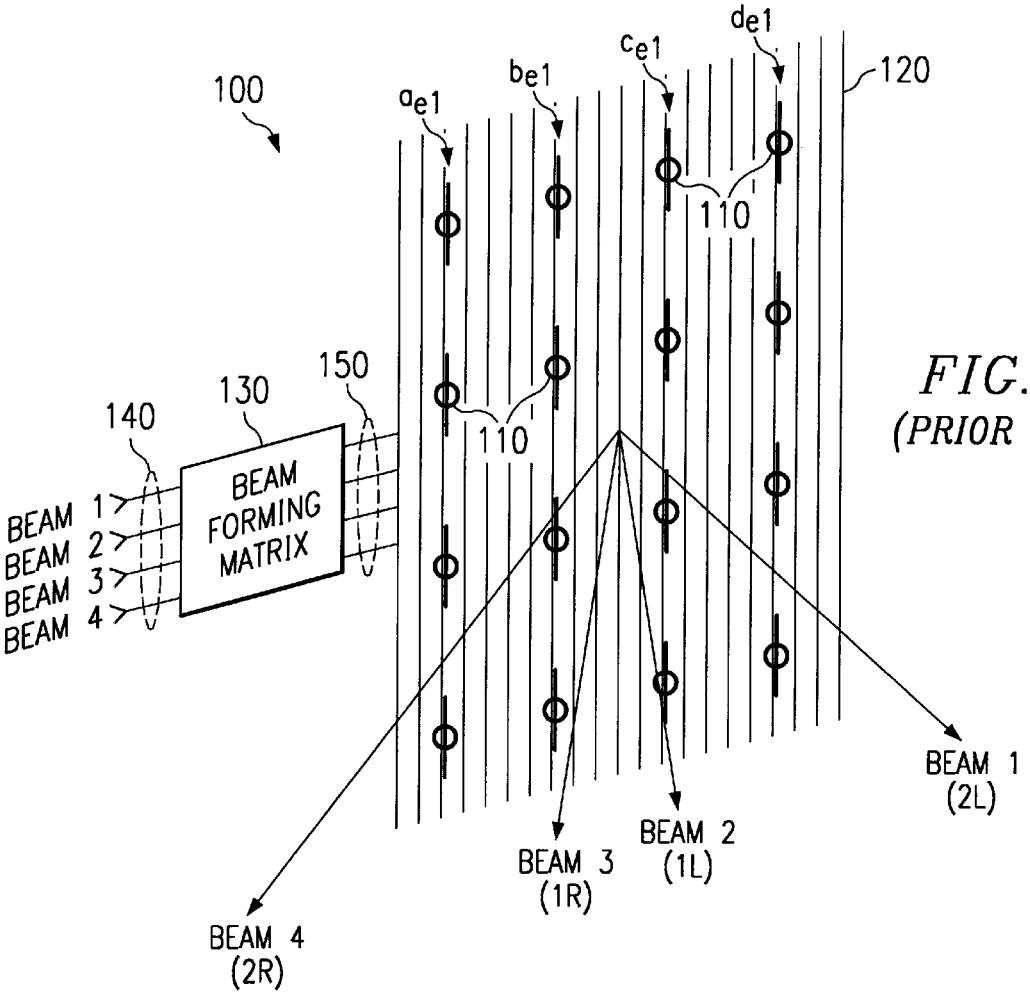
FIG. 1 (PRIOR ART)
FIG. 1 shows a prior art phased array panel antenna adapted to provide four antenna beams.

A typical prior art planar array suitable for producing antenna beams directed in desired azimuthal orientations is illustrated in FIG. 1 as antenna array 100. Antenna array 100 is composed of individual antenna elements 110 arranged in a predetermined pattern to form four columns, columns $a_{e1}$ through $d_{e1}$, of four elements each. These antenna elements are disposed a predetermined fraction of a wavelength (λ) in front of ground plane 120, such as ¼λ above ground plane 120. It shall be appreciated that energy radiated from antenna elements 110 is provided in a predetermined phase progression as among the antenna columns, which combined with energy reflected from ground plane 120, sums to form a radiation pattern having a wave front propagating in a predetermined direction.

As shown in FIG. 1, beam forming matrix 130 may include inputs 140, each associated with a particular antenna beam of a multiple beam array, such that a signal provided to any one of these inputs is provided in a predetermined phase progression at each of outputs 150. This type of fixed beam arrangement is common where beam forming matrix 130 is a feed matrix such as a Butler or hybrid matrix. Beam forming matrixes, such as a Butler matrix, are well known in the art. These matrixes typically provide for various phase delays to be introduced in the signal provided to various columns of the antenna array such that the radiation patterns of each column sum to result in a composite radiation pattern having a primary lobe propagating in a predetermined direction. Of course, rather than a fixed beam arrangement utilizing a Butler or hybrid matrix, a signal input to beam forming matrix 130 may be adaptively provided to outputs 150 in a desired phase progression to adaptively steer an antenna beam.

In the example illustrated in FIG. 1, each of the beams 1 through 4 is formed by beam forming matrix 130 properly applying an input signal to antenna columns $a_{e1}$ through $d_{e1}$. These beams are commonly referred to from right to left as beams 2L, 1L, 1R, and 2R corresponding to beams 1 through 4 of FIG. 1, and may be utilized to provide communications in a particular area. For example, each of the beams of FIG. 1 may be 30° beams to provide communications in a 120° sector.

Figure 2:
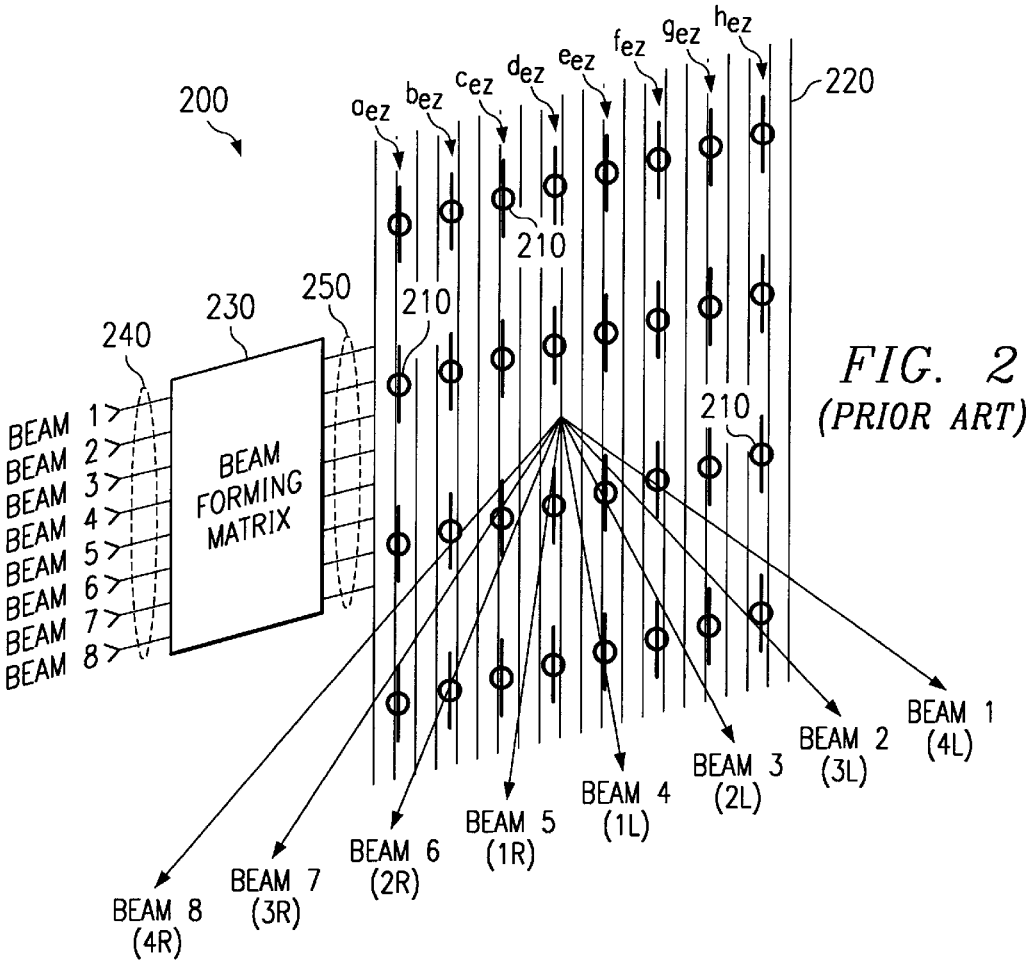
FIG. 2 (PRIOR ART)
FIG. 2 shows a prior art phase array panel antenna adapted to provide eight antenna beams.

Another embodiment of a planar array suitable for producing antenna beams directed in desired azimuthal orientations is illustrated in FIG. 2 as antenna array 200. As with the array of FIG. 1, antenna array 200 is composed of individual antenna elements 210 arranged in a predetermined pattern, although antenna 200 forms eight columns, columns $a_{e2}$ through $h_{e2}$, of four elements each. These antenna elements are disposed a predetermined fraction of a wavelength (λ) in front of ground plane 220, such as ¼λ and energy radiated from antenna elements 210 is provided in a predetermined phase progression as among the antenna columns, which combined with energy reflected from ground plane 220, sums to form a radiation pattern having a wave front propagating in a predetermined direction.

As described above, beam forming matrix 230 may include inputs 240, each associated with a particular antenna beam of a multiple beam array, such that a signal provided to any one of these inputs is provided in a predetermined phase progression at each of outputs 250 or, alternatively, a signal input to beam forming matrix 130 may be adaptively provided to outputs 250 in a desired phase progression to adaptively steer an antenna beam.

Beams 1 through 8 of FIG. 2 are commonly referred to from right to left as beams 4L, 3L, 2L, 1L, 1R, 2R, 3R, and 4R, and may be utilized to provide communications in a particular area. For example, each of the beams of FIG. 2 may be 15° beams to provide communications in a 120° sector.

The composite radiation patterns of the columns of an antenna array, such as the beams illustrated in FIGS. 1 and 2, may be azimuthally steered from the broadside through adjusting the aforementioned phase progression. For example, beam 2L (beam 1 of FIG. 1) may be steered 45° from the broadside direction through the introduction of an increasing phase lag (Δ, where Δ<0) between the signals provided to columns $a_{e1}$ through $d_{e1}$. Assuming that the horizontal spacing between each of the columns $a_{e1}$ through $d_{e1}$ is the same, beam 2R may be created by providing column $a_{e1}$ with the input signal in phase, column b., with the input signal phase retarded Δ, column $c_{e1}$ with the input signal phase retarded 2Δ, and column $d_{e1}$ with the input signal phase retarded 3Δ. Of course the exact value of Δ depends on the spacing between the columns.

Similarly, beam 1L (beam 2 of FIG. 1) may be 15° from the broadside direction through the introduction of a phase lag between the signals provided to the columns. Here, however, the phase differential need not be as great as with beam 2R above as the deflection from broadside is not as great. For example, beam 1R may be created by providing column $a_{e1}$ with the input signal in phase, column $b_{e1}$ with the input signal phase retarded ⅓ΔA, column $c_{e1}$ with the input signal phase retarded ⅔Δ (2*⅓Δ), and column $d_{e1}$ with the input signal phase retarded Δ (3*⅓Δ).

It shall be appreciated that, when a linear planar array is excited uniformly (uniform aperture distribution) to produce a broadsided beam projection, the composite aperture distribution resembles a rectangular shape. However, when this shape is Fourier transformed in space, the resultant pattern is laden with high level side lobes relative to the main lobe. When beam steering is used, i.e., the beam is directed away from the broadside, these side lobes grow to higher levels and ultimately result in grating lobes being formed. For example, beam 2R of FIG. 1 will have associated therewith larger side lobes than those of beam 1R and, therefore, present a radiation pattern typically less desirable than that of beam 1R of FIG. 1.

Figure 3:
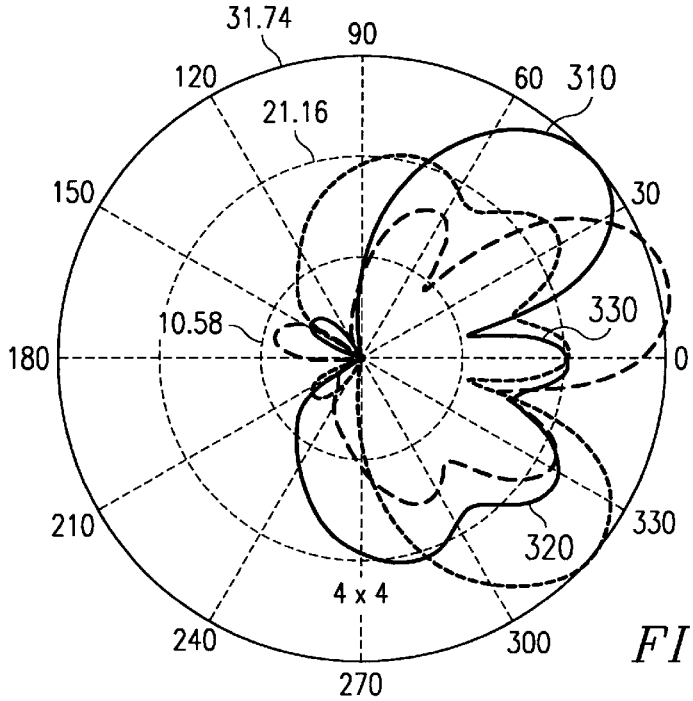
FIG. 3 shows an antenna pattern of the phased array panel antenna of FIG. 1.

Directing attention to FIG. 3, an estimated azimuth far-field radiation pattern using the method of moments with respect to the antenna array shown in FIG. 1 is illustrated. Here the antenna columns are uniformly excited to produce main lobe 310 substantially 45° from the broadside and, thus, substantially as described above with respect to beam 2R.

It shall be understood that, since a beam steered a significant angle away from the broadside, such as beam 2R, presents a less desirable radiation pattern than that of a beam having a lesser angle, such as beam 1R, discussion of the present invention is directed to a beam having a significant angle to more readily illustrate radiation pattern improvement. However, the radiation patterns of beams deflected more or less from the broadside than those described will be similarly improved according to the present invention.

Referring again to FIG. 3, grating lobe 320 and side lobe 330 are illustrated within the 120° sector coverage area of antenna array 100. It can be seen that grating lobe 320 is a substantial lobe peaking only approximately 8 dB less than main lobe 310. The side lobe and grating lobe in particular, act to degrade the performance of the antenna system by making it responsive to signals in an undesired direction, potentially interfering with the desired signal. Specifically, as 0° represents the broadside direction, grating lobe 320 is directed such that communication devices located in front of antenna array 100 may not be excluded from communication when the array is energized to be directed 45° from the broadside.

Moreover, it can be seen from FIG. 3 that, although the 3 dB down points define a beam width of approximately 34°, this beam is somewhat asymmetrical. Specifically, the main lobe exhibits a considerable bulge opposite the aforementioned high level side lobes. This bulge causes the beam to irregularly taper from the 3 dB down points. Therefore, such a beam presents added opportunity for interference by an undesired communication device.

The present invention provides an antenna array which may be utilized to provide antenna beams substantially similar to those of a standard prior art antenna array, including providing coverage within a sector of substantially the same area, with reduced grating and side lobes. According to the present invention, an array having antenna elements sufficient to provide antenna beams in addition to those actually desired, or antenna beams otherwise different than those actually desired, in combination with deploying those antenna elements with a particular inter-element spacing provides improved beam characteristics.

Specifically, a preferred embodiment of the present invention utilizes a beam forming matrix having $2^{n+1}$ inputs for forming $2^n$ antenna beams. Accordingly, to provide four ($2^2$) antenna beams suitable for use in place of those of FIG. 1, an antenna system of this preferred embodiment of the present invention utilizes a beam forming matrix having eight ($2^3$) inputs and outputs, although only four inputs are used, in combination with eight columns of antenna elements spaced according to the present invention. However, it should be appreciated that alternative embodiments of the present invention may utilize beam forming networks presenting antenna signal weighting (phase and/or amplitude progression) consistent with that of the preferred embodiment described above, without providing the aforementioned additional inputs. For example, an adaptive beam forming network, such as may be provided by controllable phase shifters and/or amplitude adjusters, may be utilized to provide properly weighted signals for use with antenna arrays configured according to the present invention.

Figure 4:
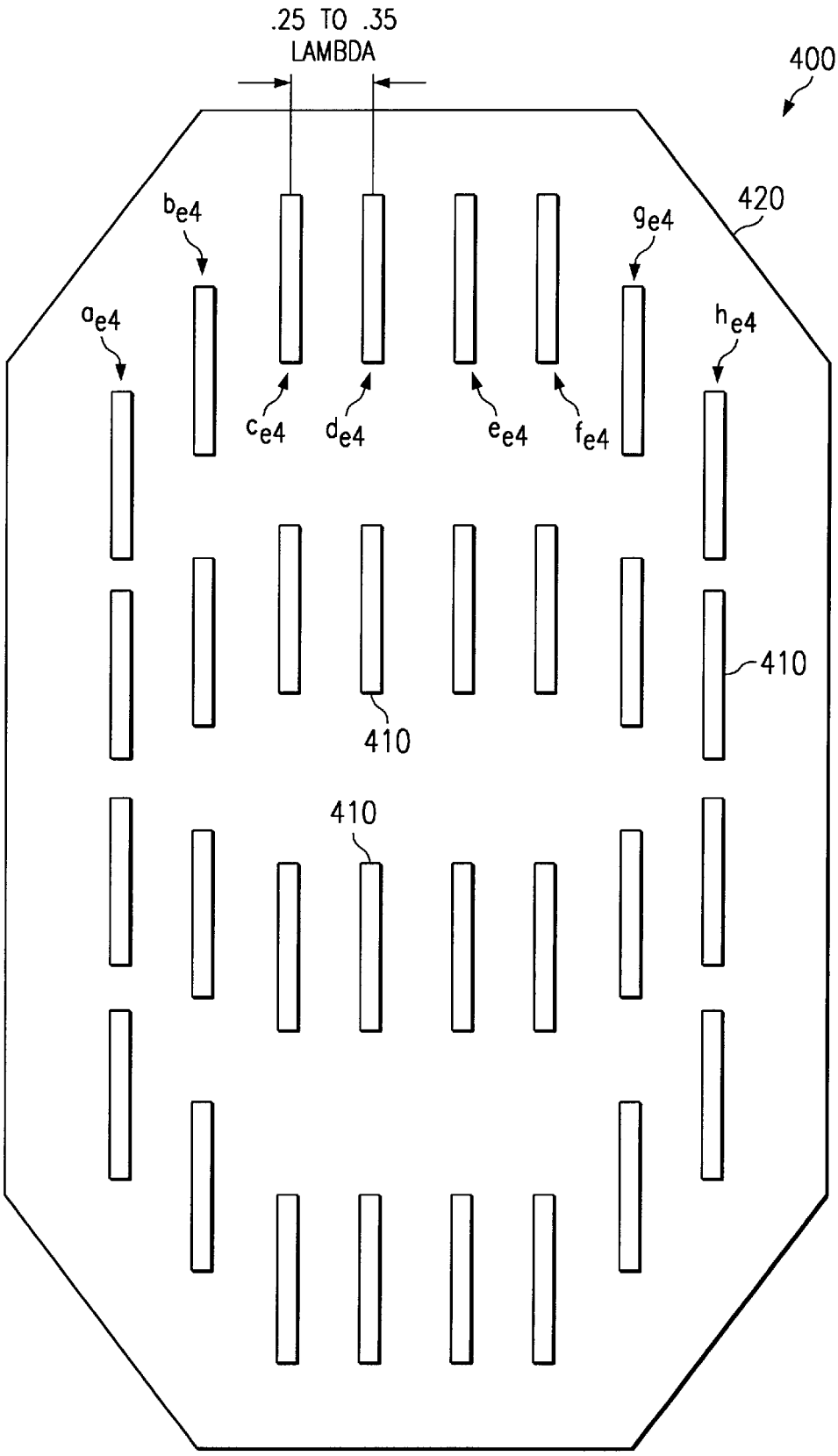
FIGS. 4 and 5 show a phased array panel antenna adapted according to the present invention.

Directing attention to FIG. 4, the above described preferred embodiment antenna adapted according to the present invention to provide four antenna beams having reduced side and grating lobes is shown generally as antenna array 400. It can be seen that like antenna array 200 of FIG. 2, antenna array 400 includes eight radiator columns, columns $a_{e4}$–$h_{e4}$, of four antenna elements 410 each. It shall be appreciated that the preferred embodiment antenna array 400 of FIG. 4 is shown having a number of radiating columns and antenna elements consistent with the above described example of providing four antenna beams in a particular sector according to the present invention in order to aid those of skill in understanding the present invention, and is not intended to limit the present invention to any particular number of radiating columns, antenna elements, or even to the use of a planar panel array.

Preferably the antenna elements utilized in antenna array 400 are dipole antenna elements. However, other antenna elements may be utilized according to the present invention, including helical antenna elements, patch antenna elements, cavity slot antenna elements, and the like. Moreover, although antenna elements polarized vertically are shown, the present invention may be utilized with any polarization, including horizontal, slant right, slant left, elliptical, and circular. It should also be appreciated that a multiplicity of polarizations may be used according to the present invention, such as by interleaving slant left and slant right antenna columns to provide an antenna system having polarization diversity among the antenna beams provided. These polarization diverse antenna beams may be alternate ones of the substantially non-overlapping antenna beams illustrated in FIG. 4 or, alternatively, may be provided to overlap corresponding beams of an alternative polarization, such as by substantially interleaving two of antenna array 400, each having a different polarization, to provide a polarization diverse antenna array.

In accordance with the principals of the present invention, the antenna columns of antenna array 400 are more closely spaced than those of antenna array 200. For example, rather than a typical inter-column spacing of 0.5λ common in a typical phased array such as that of FIG. 2, the array of FIG. 4 utilizes a more narrow inter-column spacing, such as in the preferred embodiment range of 0.25 to 0.35λ, although the same phase progression as that utilized in the 0.5λ element spacing is maintained. A most preferred embodiment of the present invention utilizes an inter-column spacing of 0.27λ where eight antenna columns are coupled to an eight by eight beam forming matrix to provide four substantially 30° antenna beams defining an approximately 120° sector. The use of this more narrow inter-column spacing, in combination with the adaptation of the beam forming network coupled to antenna array 400 to utilize phase progressions generally associated with antenna beams steered at angles from the broadside less than those generally available from an array such as antenna array 200, provides improved grating lobe and side lobe control according to the present invention.

Figure 5:
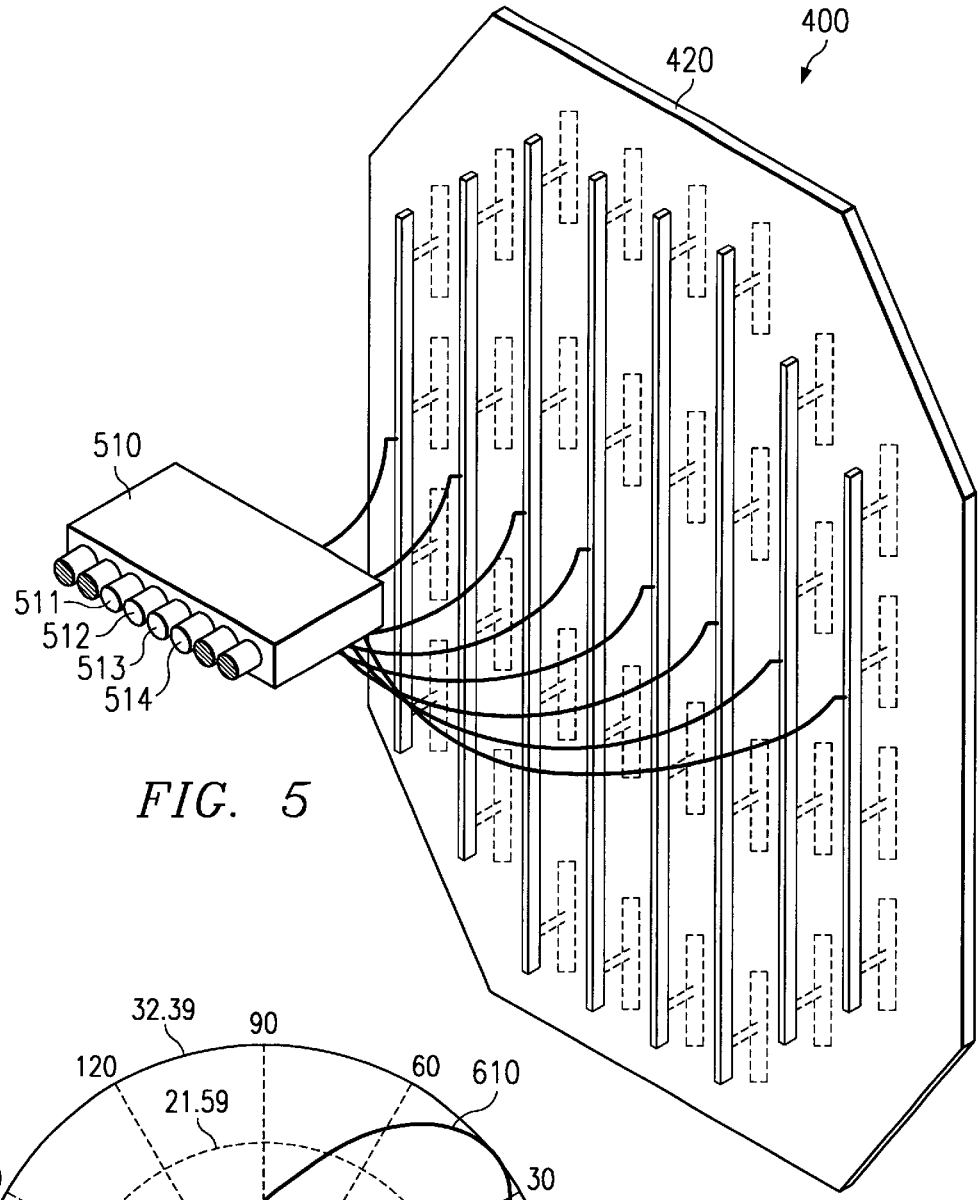

Directing attention to FIG. 5, antenna 400 of FIG. 4 is shown from a reverse angle to reveal the antenna feed network including beam forming matrix 510. Beam forming matrix 510 of the illustrated embodiment is an 8×8 beam forming matrix, such as an 8×8 Butler matrix well known in the art. However, beam forming matrix 510, although providing eight inputs, is adapted to terminate the outer most inputs, i.e., the inputs associated with the outer most antenna beams of an antenna array such as that of FIG. 2, and thus utilizes only the inner most inputs, here the four inner inputs. Accordingly, a signal coupled to each one of inputs 511–514 will be provided as signal components having a particular phase progression at each of the eight outputs of beam forming matrix 510, and thus will be coupled to each of the radiating columns of antenna array 400. Therefore, although the antenna array may be capable of forming a number of beams in excess of those desired, only the inner beams are used. For example, in the preferred embodiment of FIGS. 4 and 5, only the 2R, 1R, 1L, and 2R beams are used out of an available combination of 3R, 3R, 2R, 1R, 1L, 2L, 3L, and 4L beams. These inner most beams typically have better radiation characteristics than the outer most beams and therefore do not present the grating lobes it is a purpose of the present invention to avoid.

It should be appreciated that without the adjusted inter-element placement of the present invention, the use of the inner four inputs of the beam forming matrix would not provide antenna beams consistent with those desired, i.e., antenna beams sized directed substantially the same as those of antenna array 100. For example, rather than providing four approximately 30° antenna beams which define a 120° sector, the 2R, 1R, 1L, and 2R beams of the 8×8 beam forming matrix used according to the present invention may provide four approximately 15° antenna beams which define a 60° sector without the adjusted inter-element placement because of the increased number of antenna columns energized in the phase progression. Accordingly, the present invention, in addition to the use of a beam forming matrix having inputs/outputs, and antenna array having antenna columns, in addition to those associated with the desired antenna beams, includes adjustment of the antenna column and/or row spacing to re-size and re-point the used beams in the desired direction and, thus, the above described preferred embodiment antenna array having an ×8 beam forming matrix may be utilized to provide four substantially 30° beams defining a 120° sector.

Additional techniques for providing a desired antenna beam may be utilized according to the present invention, if desired. For example, use may be made of parasitic elements, such as shown and described in the above referenced patent application entitled "Multiple Beam Planar Array With Parasitic Elements," in addition to the driven elements shown in FIGS. 4 and 5.

Referring still to the preferred embodiment antenna array of FIGS. 4 and 5, it can be seen that the outer columns of antenna elements, columns $a_{e4}$, $b_{e4}$, $g_{e4}$ and $h_{e4}$, are compressed vertically. By placing reduced in length antenna columns on the outer edges of a phased array, aperture tapering for side lobe level control is further accomplished according to the present invention. Preferably, reduction of the length of the outer antenna columns provides an edge antenna column which is substantially the same length as an antenna column of the array which is not reduced in length but having had its top most and bottom most element removed, i.e., presenting an antenna broadside substantially the size of an array having the corner elements removed. Additional antenna columns may be reduced in length a portion of the amount the outer antenna columns are reduced in length, such as illustrated by the antenna columns next to the outer antenna columns in FIGS. 4 and 5, to further taper the antenna aperture. Of course an alternative embodiment of the present invention may utilize more or fewer antenna columns of reduced length or even antenna columns of all substantially the same length, where the additional side lobe level control afforded is not desired.

The signal feed lines for the antenna columns illustrated in FIG. 5 may be any of a number of feed mechanisms, including coaxial cable with taps at points corresponding to the individual elements, micro-strip lines, and the like. However, a preferred embodiment of the present invention utilizes air-line busses to feed the antenna columns. Preferably, the air-line bus of each column is coupled to the beam forming matrix at a mid point, such as between the middle two antennas of the illustrated columns as shown in FIG. 5. Such a connection aids in providing even power distribution amongst the antenna elements of the column.

It shall be appreciated that a 180° phase shift is experienced in the excitation of the antenna elements disposed on the air-line above the air-line/feed network tap as compared to the antenna elements disposed on the air-line below the air-line/feed network tap. Accordingly, ones of the antenna elements, such as the upper two antenna elements of each column, may be provided with a balun coupled to upper dipole half whereas other ones of the antenna elements, such as the lower two antenna elements of each column, may be provided with a balun coupled to lower dipole half.

It shall be appreciated that in an air-line bus most of the energy is confined in the space between the air-line bus and the ground plane. Accordingly, by placing a dielectric in this space the transmission properties of the antenna column may be substantially altered. Experimentation has revealed that by placing a dielectric between the air-line bus and the ground plane of the antenna array the propagation velocity of the electromagnetic energy being distributed along the column is retarded. This retardation of the propagation velocity, and the subsequent compression of the wave length, allows the spacing of the dipoles to be reduced. This reduction in inter-element spacing is done without adversely affecting the grating lobes. Accordingly, the preferred embodiment utilizes a dielectric between the air-line bus and the ground plane of the antenna array adapted according to the present invention. It shall be appreciated that by utilizing the dielectric line bus of the preferred embodiment, it is possible to taper the aperture of the array without adjusting the number of antenna elements provided in any of the antenna columns. Accordingly, balancing power among the antenna columns of the array is greatly simplified as providing a signal of equal power to each antenna column does not result in energization of the columns in an aperture distribution approaching an inverse cosine distribution as in the prior art. Although described herein with sufficient detail to allow one of skill in the art to understand the present invention, further detail with respect to the use of such air-line bus feed systems is provided in the above reference patent application entitled "System and Method for Per Beam Elevation Scanning."

Figure 6:
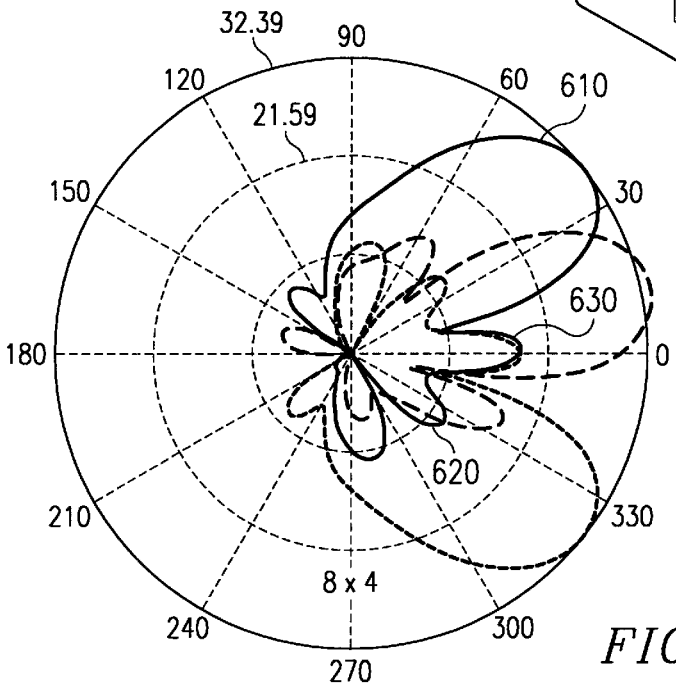
FIG. 6 shows an antenna pattern of the phased array panel antenna of FIGS. 4 and 5.

Having described the preferred embodiment antenna array 400 adapted according to the present invention, attention is directed to FIG. 6, wherein an estimated azimuth far-field radiation pattern using the method of moments with respect to the antenna array shown in FIGS. 4 and 5 is illustrated. Here the antenna columns are uniformly excited, such as through application of a signal to input 511 of beam forming matrix 510, to produce main lobe 610 substantially 45° from the broadside and, thus, substantially as described above with respect to beam 2R associated with the antenna array of FIG. 1. However, it should be appreciated that the grating lobe present in FIG. 3 has been avoided and instead much smaller side lobes 620 and 630 are present. Accordingly, main lobe 610 may be utilized to conduct communications substantially to the exclusion of signals or interference present in other areas to the front of antenna array 400. Moreover, it should be appreciated that main lobe 601 is substantially symmetric and thus provides a beam more suited to providing communications within a defined subsection of an area to be served.

It should be understood that applying a signal to any one of inputs 511–514 of beam forming matrix 510 will provide an antenna beam substantially as illustrated in FIG. 6, although the azimuthal angle of each such beam will be different. Accordingly, a switched beam system, useful in communications wherein reuse of particular channels is desired, having multiple predefined antenna beams each having a particular azimuthal orientation is defined. Such a system is useful for providing wireless communication services such as the cellular telephone communications of an AMPS network, as channel reuse may be increased through limiting communications on a particular channel to within antenna beams which are unlikely to result in interfering signals.

However, the communication requirements of other modes of communication may be somewhat different than that of a particular network, such as the aforementioned AMPS network. For example, CDMA communication networks utilize a same broadband channel for multiple discrete communications, relying upon unique chip codes to separate the signals. Accordingly, although capacity is interference limited, i.e., a particular threshold of communicated energy is established over which it becomes very difficult to extract a particular signal and therefore signals are communicated in defined areas, a larger area than that defined by individual beams may be desired for use in communications, such as to avoid system overhead functions such as handoff conditions. Therefore, it may be desirable to provide a first mode (i.e., AMPS) signal in a particular antenna beam while providing a second mode (i.e., CDMA) signal in multiple beams, such as four beams defining a sector.

The inter-element spacing of the preferred embodiment of the present invention is optimized not only to provide desired control over grating and side lobes, but also to provide a desirable radiation pattern when the array is simultaneously excited at multiple or all beam inputs. Where dual mode signals including AMPS and CDMA signals are to be utilized simultaneously from a single antenna array of the present invention, a preferred embodiment utilizes inter-column spacing of 0.27λ in order to optimize the radiation pattern resulting from both single beam excitation (associated with a first communication mode) and multiple beam excitation (associated with a second communication mode). Additionally or alternatively, where the antenna element columns are closely spaced according to the present invention for a lower frequency band, the same columns may be optimally or near optimally spaced for higher frequency band using conventional beam forming techniques, thereby providing a dual mode antenna configuration. Accordingly, a dual band dipole-radiating element may be utilized in such an embodiment, possibly with additional high frequency elements placed along the array's rows to suppress any occurrence of elevation plane grating lobes.

Figure 7:
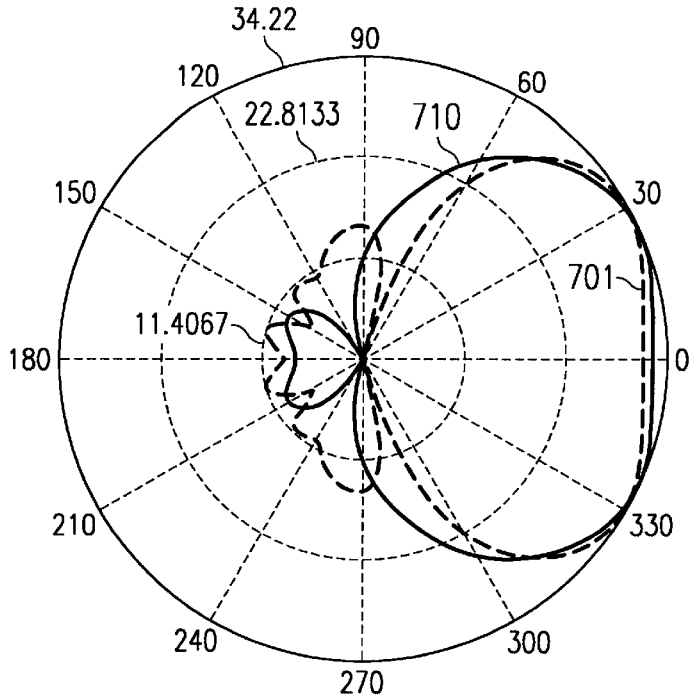
FIGS. 7 and 8 show synthesized sector antenna patterns of the phased array panel antennas of FIG. 1 and FIG. 4.
Figure 8:
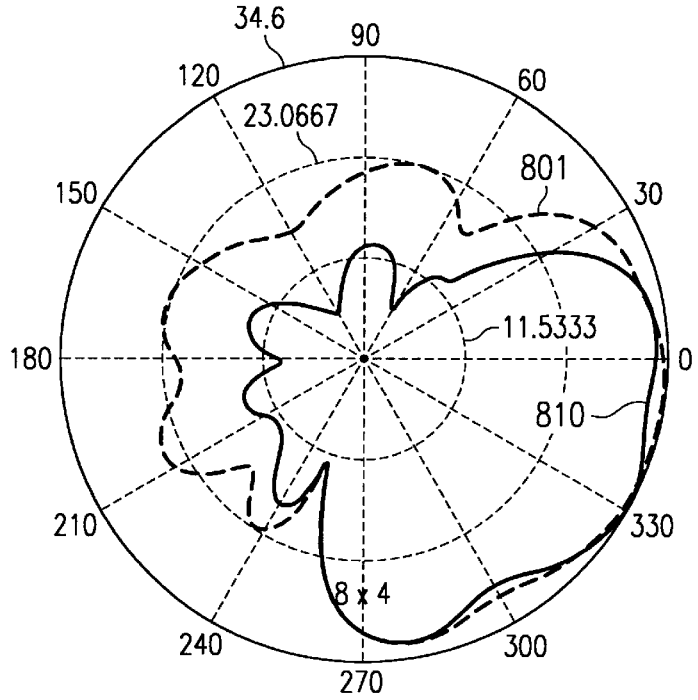

Directing attention to FIGS. 7 and 8, radiation patterns associated with sector signals radiated utilizing antenna arrays substantially as illustrated in FIGS. 1 and 4 are shown. Specifically, radiation pattern 701 results from providing a sector signal in a weighted distribution at multiple ones of the inputs of antenna array 100 and radiation pattern 710 results from providing a sector signal in a weighted distribution at multiple ones of the inputs of antenna array 400. The weighting of the multiple inputs utilized in both of the cases above is the beam forming matrix input associated with beam 2L having the input sector signal −1.5 dB at −78.50°, the beam forming matrix input associated with beam 1L having the input sector signal 0.0 dB at +78.75°, the beam forming matrix input associated with beam 1R having the input sector signal 0.0 dB at +78.75°, and the beam forming matrix input associated with beam 2R having the input sector signal −1.5 dB at −78.50°.

The radiation patterns of FIG. 8 illustrate the use of multiple antenna panels in the generation of a composite antenna beam as is described in detail in the above referenced patent application entitled "System and Method Providing Delays for CDMA Nulling." Accordingly, the composite radiation patterns of FIG. 8 are formed from a sector signal provided in a weighted distribution at multiple ones of the inputs of a first antenna array and an input of a second antenna array which is disposed to provide substantially non-overlapping contiguous coverage with that of the first antenna array. Specifically, radiation pattern 801 results from providing a sector signal in a weighted distribution at multiple ones of the inputs of a first antenna array 100 and a single one of the inputs of a second antenna array 100 and radiation pattern 810 results from providing a sector signal in a weighted distribution at multiple ones of the inputs of a first antenna array 400 and a single one of the inputs of a second antenna array 400. The weighting of the multiple inputs utilized in both of the cases above is with respect to the first antenna panel the beam forming matrix input associated with beam 1L having the input sector signal −0.5 dB at +78.50°, the beam forming matrix input associated with beam 1R having the input sector signal −0.5 dB at +78.75°, and the beam forming matrix input associated with beam 2R having the input sector signal 0.0 dB at −78.50°, and with respect to the second antenna panel the beam forming matrix input associated with beam 2L having the input sector signal 0.0 dB at −78.50° (although any phase relationship may be utilized for the inputs of the second panel when provided with delays as between the first and second panel as shown in the above referenced patent application entitled "System and Method Providing Delays for CDMA Nulling").

Although the specific example shown utilizes only a single input of the second antenna panel, it should be appreciated that there is no such limitation. For example, 2 inputs of a first panel and 2 inputs of a second panel may be utilized in providing a composite radiation pattern synthesizing a desired sector utilizing antennas adapted according to the present invention, if desired. Moreover, there is no limitation to the number of such antennas utilized. For example, a very large antenna composite antenna pattern, i.e., a 360° sector, may be formed utilizing antennas of the present invention by providing the sector signal with proper weighting to inputs of 3 antenna arrays each adapted to provide radiation patterns in a 120° arc.

It can be seen by comparing the radiation patterns of FIGS. 7 and 8 that the back scatter associated with the sector pattern of antenna array 400 is greatly improved over that of antenna array 100. Accordingly, there is less area in which interfering signals or other noise will be received in the synthesized sector beam of the antenna of the present invention. As such, antennas of the present invention are uniquely advantageous in allowing sectors of desired sizes to be synthesized and, therefore, selectable as necessary, such as to improve trunking. Moreover, it should be appreciated that the above sector synthesis is provided simultaneously with the ability to provide signals within discrete narrow antenna beams formed by the antenna of the present invention. Accordingly, the present invention simultaneously provides very desirable features for multiple communication modes.

Figure 9A:
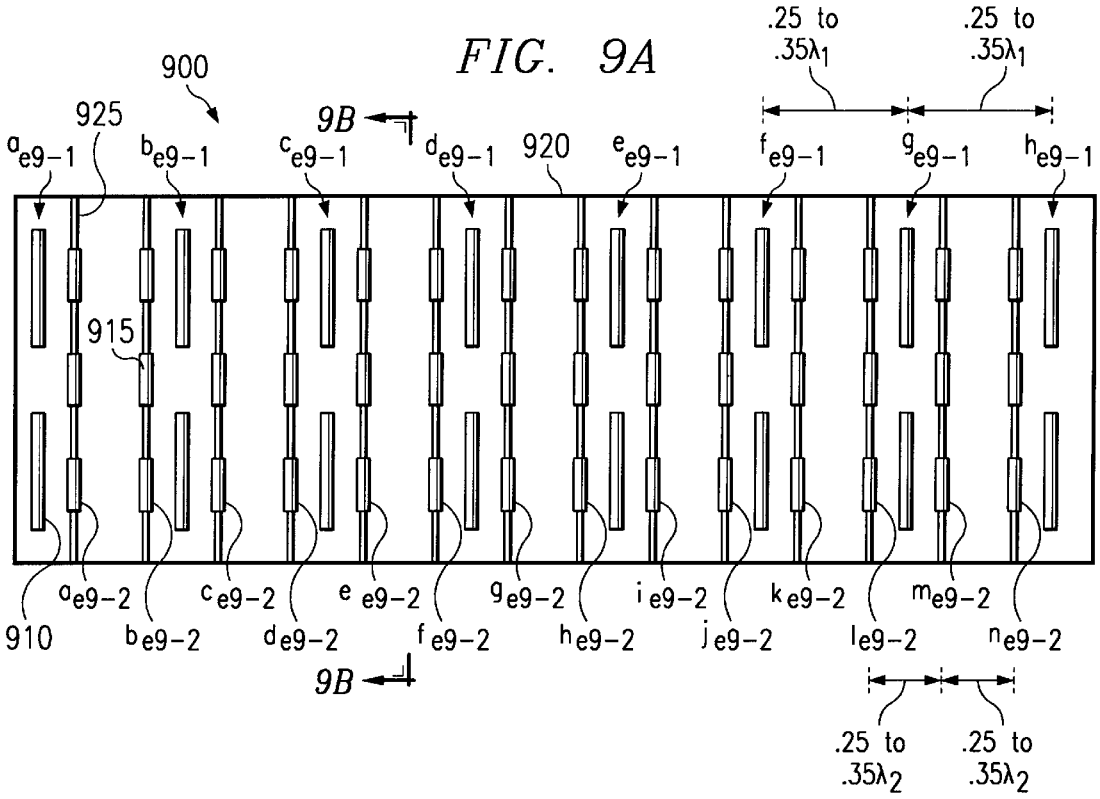
FIGS. 9A–9C and 10 show a multi-mode phased array panel antenna adapted according to the present invention.
Figure 9B:
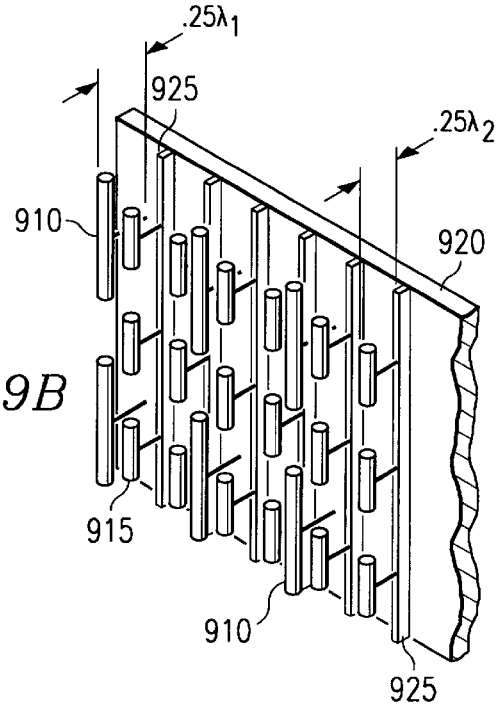
Figure 9C:
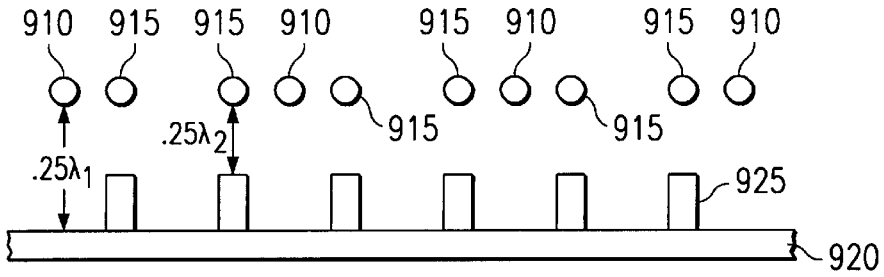
Figure 10:
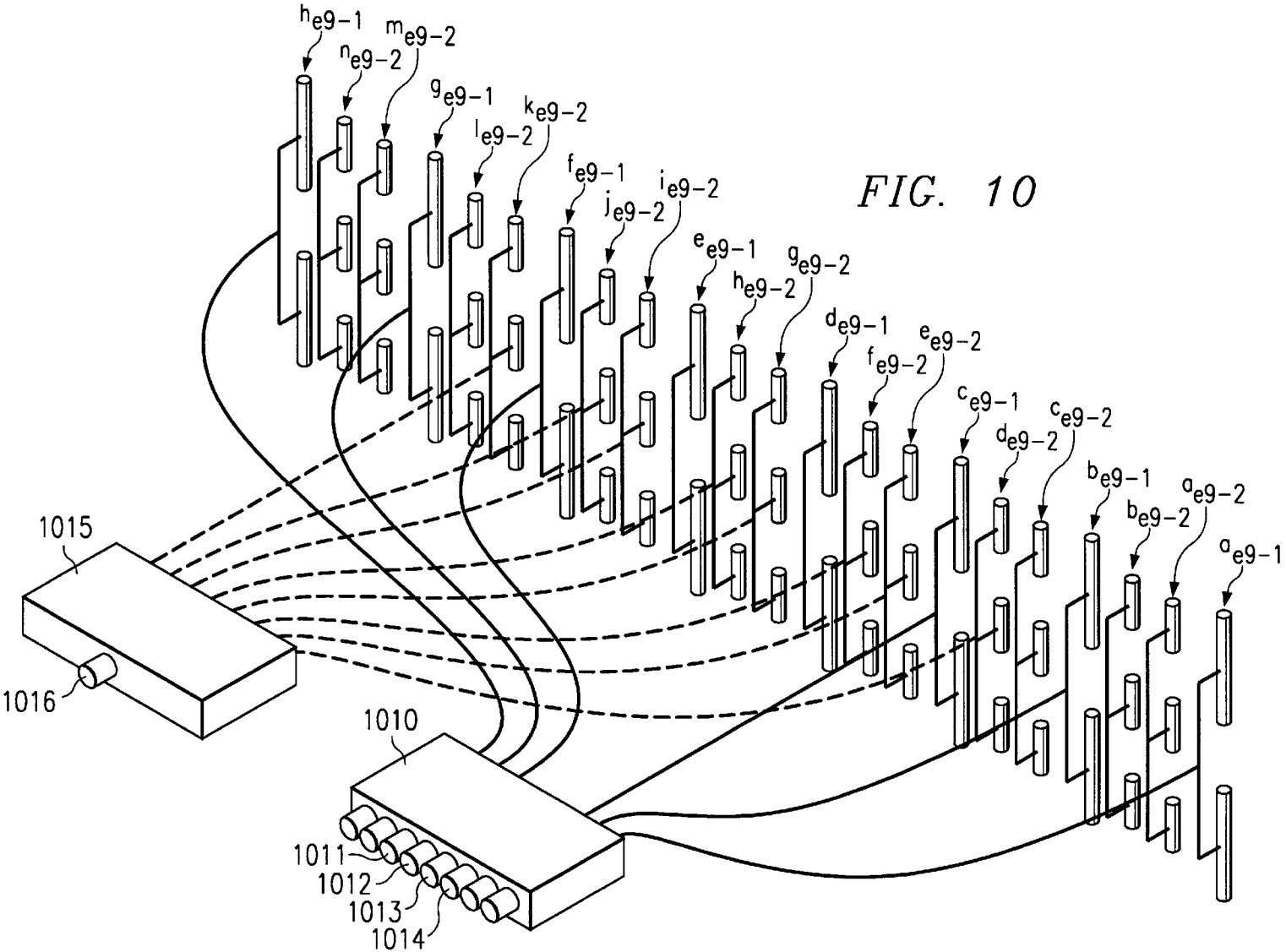

Another embodiment of a dual mode antenna configuration of the present invention is shown in FIGS. 9A–9C, and 10. Specifically, FIG. 9A shows antenna 900 in a broadside view, FIG. 9B shows a partial isometric view of antenna 900 from the front, and FIG. 9C shows a partial top view of antenna 900. FIG. 10 provides a view of antenna 900 from the back, with the ground plane having been removed for clarity.

FIGS. 9A–9C, and 10 show a preferred embodiment dual mode antenna in which a first group of antenna elements, elements 910 disposed in columns $a_{e9\text{-}2}$–$h_{e9\text{-}1}$, are adapted for use with a first communication service or frequency band and a second group of antenna elements, elements 915 disposed in columns $a_{e9\text{-}2}$–$n_{e9\text{-}2}$, are adapted for use with a second communication service or frequency band. Specifically, antenna element columns for use with each communication service are interspersed with respect to antenna element columns of another communication service. Accordingly, the preferred embodiment interspersed element dual band configuration provides an antenna system having a single antenna aperture for multiple communication services.

Preferably, each of the antenna element groups of antenna 900 are disposed to provide an antenna adapted according to the present invention and, therefore, preferably adopt the inter-element described above. Accordingly, columns $a_{e9-1}$ –$h_{9-1}$ are preferably spaced approximately $0.25\lambda_1$ to $0.35\lambda_1$ with respect to each other, wherein $\lambda_1$ is the wavelength (preferably the mid-frequency wavelength) associated with the frequency band of the first communication service ($f_1$). Likewise, columns $a_{e9-2}$–$n_{e9-2}$ are preferably spaced approximately $0.25\lambda_2$ to $0.35\lambda_2$ with respect to each other, wherein $\lambda_2$ is the wavelength (preferably the mid-frequency wavelength) associated with the frequency band of the second communication service ($f_2$). Similarly, the antenna elements of antenna 900 are preferably disposed a predetermined function of an operative wavelength, such as ¼λ, above ground plane 920. Accordingly, the geometry of each such group of antenna elements may be tuned for the respective communication service or frequency band used therewith.

However, it should be appreciated that the wavelengths associated with the first and second communication services of antenna 900 may be appreciably different. For example, antenna 900 may be utilized in providing standard cellular communication services, such as through use of antenna element columns $a_{e9-1}$–$h_{e9-1}$, and personal communication services, such as through use of antenna element columns $a_{e9-2}$–$n_{e9-2}$. Accordingly, the wavelength associated with the first communication service (e.g., $f_1 \approx 800$ MHz, $\lambda_1 \approx 60$ mm) may be relatively large as compared to the wavelength associated with the second communication service (e.g., $f_2 \approx 1.8$ GHz, $\lambda_2 \approx 26$ mm). Such differences in wavelength present challenges in implementing a dual mode antenna which are addressed in the preferred embodiment antenna 900, as will be more fully appreciated from the discussion provided below.

According to the illustrated embodiment, wherein $2\lambda_2 < \lambda_1$, the inter-column spacing of the preferred embodiment provides pairs of antenna element columns associated with the second communication service interspersed between antenna element columns associated with the first communication service. Specifically, in the illustrated embodiment seven pairs of antenna element columns associated with the second communication service are interspersed between eight antenna element columns associated with the first communication service, while maintaining the preferred embodiment inter-column spacing for antenna element columns of each communication service.

Accordingly, by coupling each group of antenna elements to respective beam forming circuitry, antenna 900 may be utilized to provide antenna beams having reduced side and grating lobes, such as the antenna beams discussed above with respect to FIG. 4, independently for each of the first and second communication services. Directing attention to FIG. 10, antenna 900 is shown from a reverse angle (having ground plane 920 removed) to reveal the antenna feed networks including beam forming matrix 1010 associated with the first communication service and beam forming matrix 1015 associated with the second communication service.

Beam forming matrix 1010 of the illustrated embodiment is an 8×8 beam forming matrix, such as discussed above with respect to beam forming matrix 510 of FIG. 5. Consistent with a preferred embodiment described herein, beam forming matrix 1010, although providing eight beam interfaces, is adapted to terminate the outer most beam interfaces, i.e., the interfaces associated with the outer most antenna beams of an antenna array such as that of FIG. 2, and thus utilizes only the inner most interfaces, here the four inner interfaces. Accordingly, a signal at each one of interfaces 101–1014 will have associated therewith signal components having a particular phase and/or amplitude progression at the eight antenna element interfaces of beam forming matrix 1010, and thus will be coupled to the columns of antenna array 900 associated with the first communication service, columns $a_{e9-1}$–$h_{e9-1}$. Therefore, although columns $a_{e9-1}$–$h_{e9-1}$, of the antenna array may be capable of forming a number of beams in excess of those desired, only the inner beams are used and the first communication service is provided with an antenna configured substantially as described above with respect to FIGS. 4 and 5.

Beam forming matrix 1015 of the illustrated embodiment is an adaptive beam forming matrix having eight weighted antenna element signals associated with a signal at interface 1016. For example, beam forming matrix 1015 may comprise a processor, memory, analogue digital circuitry, digital signal processing circuitry, digital to analogue circuitry, and an instruction set adapted to provide a particular phase and/or amplitude relationship with respect signals of the eight antenna element interfaces to thereby provide a desired antenna beam signal at interface 1016. However, as with beam forming matrix 1010 discussed above, beam forming matrix 1015 preferably provides a phase and/or amplitude progression consistent with an antenna array having inter-element spacing different than that of antenna 900 and, thereby, provides antenna beams of the present invention having improved characteristics.

Although beam forming matrix 1010 is illustrated as a fixed beam former and beam forming matrix 1015 is illustrated as an adaptive beam former in FIG. 10, it should be appreciated that there is no limitation to the present invention utilizing the illustrated embodiment. For example, fixed beam formers may be utilized with respect to both communication services, adaptive beam formers may be utilized with respect to both communication services, or any combination of fixed and adaptive beam formers may be utilized with respect to the communication services.

Additionally, although the preferred embodiment provides two groups of antennas each having inter-column spacing according to the present invention, it should be appreciated that alternative embodiments may utilize traditional antenna element spacing with respect to a group of antenna elements. For example, antenna elements 910 may be spaced a distance apart conventionally consistent with a phase progression provided by beam forming matrix 1010 whereas antenna elements 915 may be spaced a reduced distance apart, consistent with the concepts of the present invention described above with respect to antenna 400, where only one communication mode is to be provided the improved beam forming of the present invention.

It should be appreciated that beam forming matrix 1015 of the illustrated embodiment is coupled to only eight antenna element columns (columns $d_{e9-2}$–$k_{e9-2}$) of the fourteen antenna element columns of the second group of antenna elements (antenna elements 915). The remainder of antenna elements 915, although not directly used in the desired improved beam forming, are preferably included in order to provide a uniform radiating environment. For example, the interspersing of antenna elements of the different groups of antenna elements may affect communication using one or the other antenna element groups, such as due to the antenna elements of one group of the antenna elements presenting somewhat parasitic radiating structures with respect to antenna elements of another group of antenna elements of the above embodiment. Antenna elements of inner columns $c_{e9-1}$–$f_{e9-1}$ of the first group of antenna elements may be presented an appreciably different radiating environment than outer columns $a_{e9-1}$, $b_{e9-1}$, $g_{e9-1}$, and $h_{e9-1}$ of the first group of antenna elements if only antenna columns $d_{e9-2}$–$k_{e9-2}$ of the second group of antenna elements were present.

Accordingly, the illustrated embodiment of antenna array 900 provides antenna elements, here antenna element columns $a_{e9\text{-}2}$–$c_{e9\text{-}2}$ and $1_{e9\text{-}2}$–$h_{e9\text{-}2}$, disposed to provide a quasi-uniform radiating environment as seen by the active antenna elements. Specifically, the additional antenna element columns complete the interspersed antenna column pattern associated with the active antenna element columns. Alternative embodiments of the present invention may include more or less such additional antenna elements, if desired. Moreover, the antenna elements not directly utilized in beam forming may be omitted in particular embodiments of the present invention, such as where providing a uniform radiating environment is not of importance or where the geometry of the interspersed antenna systems is such that such elements are not needed to provide a uniform radiating environment. It should be appreciated that, although not specifically shown in FIG. 10, the additional elements may be utilized in various ways in addition to providing a uniform radiating environment. For example, one or more of antenna element columns $a_{e9\text{-}2}$–$c_{e9\text{-}2}$ and $1_{e9\text{-}2}$–$h_{e9\text{-}2}$ may be coupled to beam forming circuitry or other communications equipment (e.g., radio receiver, radio transmitter, radio transmitter, radio frequency modem, etc.) to provide antennae for use in communications, such as to provide an opposite link direction than provided with beam former 1015 and antenna element columns $d_{e9\text{-}2}$–$k_{e9\text{-}2}$. According to one such embodiment, a single antenna element column of columns $a_{e9\text{-}2}$–$c_{e9\text{-}2}$ and $1_{e9\text{-}2}$–$h_{e9\text{-}2}$ is utilized for providing a pilot signal, or other signal having common usage, throughout a relatively large area, such as a sector.

It should be appreciated that, although the illustrated embodiment of antenna 900 shows the use of eight antenna element columns in beam forming, there is no such limitation according to the present invention. Specifically, there is no limitation that eight columns be used and, accordingly, more or less than the eight shown may be used with respect to the first communication service and/or the second communication service according to the present invention. Similarly, there is no limitation that the two communication services utilize the same number of antenna element columns according to the present invention. Furthermore, there is no limitation that the interspersing of the second communication service antenna elements be disposed symmetrically with respect to the antenna elements of the first communication service. Likewise, there is no limitation to the usage of the particular antenna columns shown. For example, antenna columns having different numbers of elements, such as the four elements, of FIG. 2 above, or columns of varying numbers of elements and/or lengths of columns, such as shown in the aperture tapering of FIGS. 4 and 5 above, may be utilized according to this embodiment of the invention if desired.

According to the preferred embodiment, the antenna elements of the two groups of antenna elements are disposed in a same plane, as is illustrated in FIG. 9C. Disposing the antenna elements of both such groups in the same plane is preferred in order to minimize the effects of elements of one group with respect to elements of another group. For example, antenna elements of one group may act as reflective or directive elements with respect to the antenna elements of the other group if disposed in a different plane.

Preferably, the antenna elements of each such group of interspersed antenna elements are disposed in a plane parallel to and a quarter of the low band (e.g., $f_1$) mid-frequency wavelength above ground plane 920, e.g., in the above described example $\frac{1}{4}\lambda_1$. However, the antenna elements of each antenna element groups are preferably disposed a quarter of their respective band mid-frequency wavelength above a ground surface, e.g., antenna elements 910 are disposed $\frac{1}{4}\lambda_1$ above the ground plane and antenna elements 915 are similarly disposed $\frac{1}{4}\lambda_2$ above the ground plane. However, as discussed above, the wavelengths associated with the particular communication services utilizing antenna 900 may be appreciably different.

Accordingly, a preferred embodiment of the present invention provides adaptation of the antenna ground plane to present a ground plane surface addressing the above dichotomy. Referring again to FIG. 9C, adaptation of ground plane 920 of a preferred embodiment is shown to include raised fins 925 corresponding to antenna elements of the second group of antenna elements. Raised fins 925 preferably bring a ground surface of ground plane 920 to within ¼ of the second communication service band mid-frequency wavelength of each of antenna elements 915. Accordingly, this preferred embodiment structure allows for disposing each of antenna elements 910 and 915 in a same plane while providing a ground surface offset of ¼ of the respective frequency band wavelength.

It should be appreciated that ground plane adaptation other than the illustrated raised fin embodiment may be utilized according to the present invention. For example, a corrugated ground plane structure may be utilized in which the apexes of ones of the corrugation ridges and grooves correspond to antenna elements such that desired spacing is achieved. However, such an embodiment may not be desired where divergence of radiated signals off of the irregular ground surface produces undesired results. Other embodiments of a ground plane adapted for use according to the present invention may include a first and second ground plane surface, each disposed in the desired orientation with respect to the corresponding group of antenna elements. For example, a second ground surface, which is adapted to be substantially transparent with respect to the frequency band associated with the first antenna elements, may be disposed between a first ground surface and the antenna elements, in order to provide the desired ground plane surfaces. Transparency of such a ground surface with respect to one antenna element group might be provided, for example, where orthogonal polarizations are used for each such group of antenna elements and slots oriented to correspond to the polarization of the first antenna elements are disposed directly behind the first antenna elements.

Figure 11:
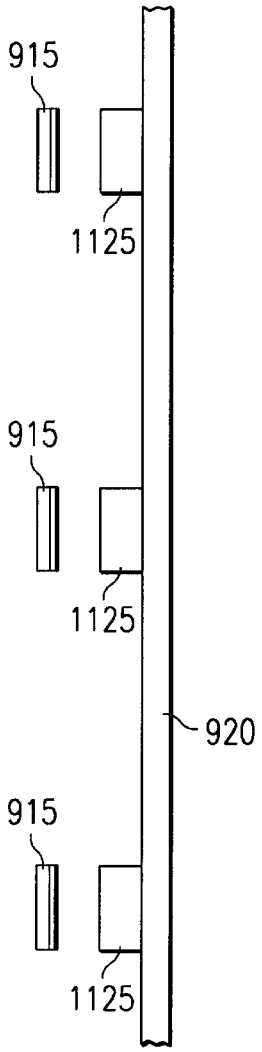
FIG. 11 shows an alternative embodiment of ground plane adaptation according to the present invention.

Directing attention to FIG. 11, an alternative embodiment of adaptation of a ground plane according to the present invention is shown. FIG. 11 shows an alternative embodiment of antenna 900 in a side view, having elements 910 omitted therefrom for clarity, having ground plane finlets 1125. Finlets 1125 are provided to substantially correspond to elements 915 for which ground plane surface alteration is desired. Accordingly, in the embodiment of FIG. 11, alteration of ground surface 920 is substantially minimized, while providing the desired ground plane relationship with respect to elements 910 and 915 as described above.

Figure 12:
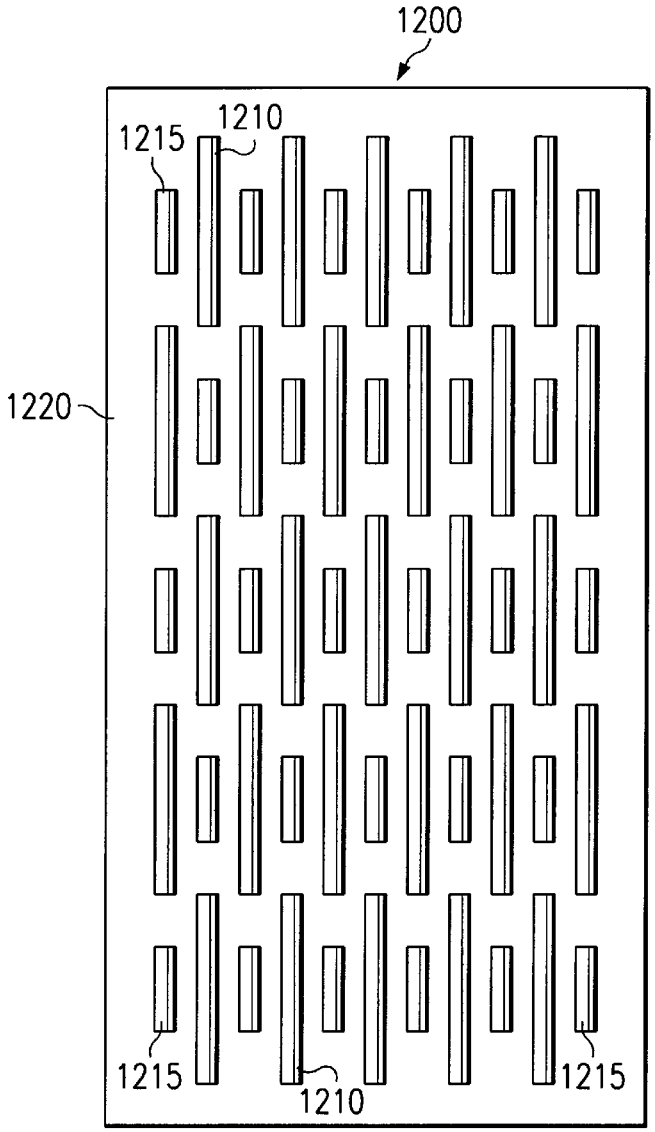
FIG. 12 shows an alternative embodiment multi-mode phased array panel antenna adapted according to the present invention.

FIG. 12 shows an example of an alternative arrangement of elements according to the present invention. Specifically, FIG. 12 shows dual mode antenna 1200 in which a first group of antenna elements, elements 1210, are adapted for use with a first communication service or frequency band and a second group of antenna elements, elements 1215, are adapted for use with a second communication service or frequency band, as described above. Accordingly, antenna element columns for use with each communication service are interspersed with respect to antenna element columns of another communication service. However, it should be appreciated that the column interleaving of antenna 1200 is different than that of antenna 900 described above.

Antenna 1200 may, for example, provide an antenna in which each of the antenna element groups are disposed to provide an antenna adapted according to the present invention. Specifically, elements 1210 may be in columns spaced approximately $0.25\lambda_1$ to $0.35\lambda_1$ with respect to each other, wherein $\lambda_1$ is the wavelength (preferably the mid-frequency wavelength) associated with the frequency band of the first communication service ($f_1$), and elements 1215 may be in columns spaced approximately $0.25\lambda_2$ to $0.35\lambda_2$ with respect to each other, wherein $\lambda_2$ is the wavelength (preferably the mid-frequency wavelength) associated with the frequency band of the second communication service ($f_2$). It should be appreciated that, unlike the preferred embodiment of antenna 900 discussed above, in this embodiment of antenna 1200, $2\lambda_2 \nless \lambda_1$, and the inter-column spacing of the preferred embodiment provides single columns of antenna elements columns associated with the second communication service interspersed between antenna element columns associated with the first communication service.

Alternatively, antenna 1200 may provide an antenna in which one group of antenna elements are disposed to provide an antenna adapted according to the present invention and the other group of antenna elements are disposed in a more traditional configuration. For example, elements 1210 may be in columns spaced approximately $0.25\lambda_1$ to $0.35\lambda_1$ with respect to each other for use with a beam forming network as described herein, while elements 1215 are disposed in a geometry for conventional application of beam forming circuitry.

It should be appreciated that the respacing of antenna elements according to the present invention results in the closing in the elemental spacing which, although having the desirable effect of reducing or even suppressing any grating lobes, may result in undesirable effects associated with the phenomena of mutual coupling. Mutual coupling can distort individual element patterns that are components in the process of beam forming. This distortion can degrade intended beam characteristics of pointing accuracy and beamwidth. Mutual coupling can manifest itself in three ways: Direct space coupling between individual array elements; Indirect coupling can occur by scattering from nearby objects such as a support tower; and The feed network that interconnects elements in the array provides a path for coupling to adversely interact with the beam-forming process. Accordingly, preferred embodiments of the invention use techniques to over come adverse effects of mutual coupling associated with antenna elements being placed in close proximity to one another.

In many practical arrays, feed network coupling can be minimized through proper impedance matching at each element. Direct space coupling may be minimized by the use of resonant and non-resonant elements making up the array, "stagger" tuning. For example, the elements of the array could consist of low, medium (resonate), and high frequency elements and the array configured such the no two of a particular type of elements are adjacent to one another in either row or column. This has the effect of "swamping" the usual real and reactive swings of the mutual coupling effect which "swings" follow a mathematical Bessel function.

Figure 13A:
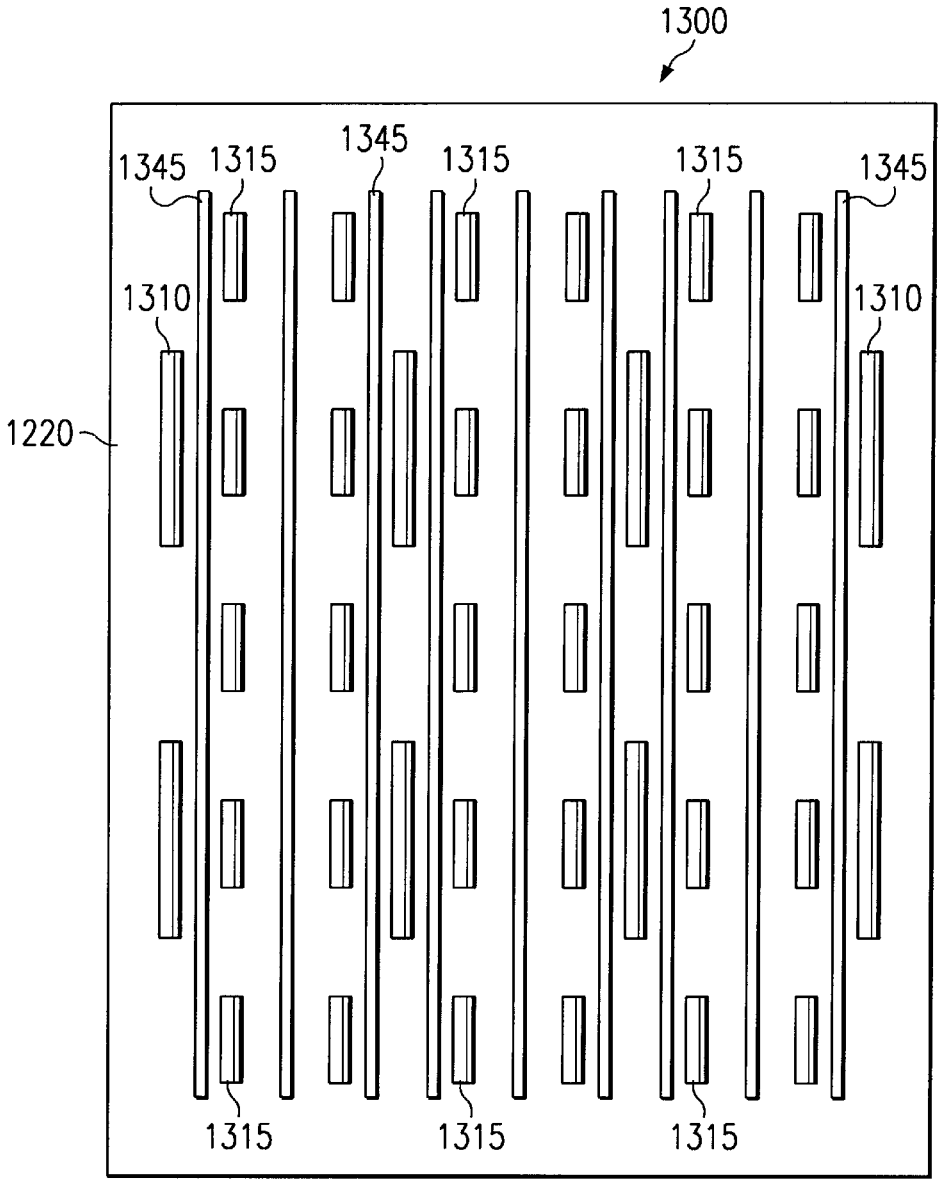
FIGS. 13A and 13B show a multi-mode phased array panel antenna adapted to mitigate mutual coupling according to a preferred embodiment of the present invention.
Figure 13B:
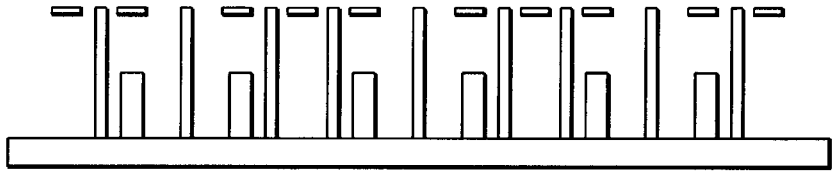

Directing attention to FIGS. 13A and 13B, an embodiment of the present invention adapted to mitigate mutual coupling attendant with the reduced element spacing of the present invention is shown as antenna 1300. Antenna 1300 is configured substantially the same as antenna 900 discussed above. Specifically, antenna 1300 includes a first group of elements 1310 and a second group of elements 1315, wherein multiple columns of elements 1315 are interspersed between columns of elements 1310. It should be appreciated that the illustrated embodiment of antenna 1300, although adopting a similar geometry to that of antenna 900 discussed above, does not include the same numbers of element columns. Such a configuration may utilize variations of the beam forming networks described above, consistent with the concepts of the present invention, for example. Additionally or alternatively, the illustrated configuration may eliminate the use of the preferred embodiment passive elements discussed above.

Antenna 1300 of FIG. 13 employs the use of electrically grounded partitions, referred to herein as "Faraday fences", between elements to thereby mitigate or eliminate mutual coupling therebetween. Specifically, Faraday fences 1345 are disposed along columns of elements to provide isolation between adjacent elements while allowing for the use of a uniform feed system. Accordingly, antenna 1300 may be particularly desirable for a mass-produced antenna product because of its ability to utilize uniformly configured parts.

Although not shown in FIG. 13, it should be appreciated that antenna 1300 may use individual element, column, and/or row impedance matching to minimize coupling associated with the feed network that interconnects elements in the array. Additionally, antenna 1300 may be deployed such that the antenna is kept away from blocking structure, such as an associated support tower, in order to minimize indirect coupling occurring by scattering from nearby objects.

Although dual mode operation of antenna systems of the present invention have been discussed above with respect to two communication services, it should be appreciated that multiple mode operation of the present invention is not limited to use with two communication services. For example, dual mode operation may be utilized with respect to a single communication service in order to provide antenna beams having various configurations, antenna beams adapted for different aspects of the communication service (such as a signaling channel and traffic channels), and the like. Similarly, more than two communication services may utilize an antenna of the present invention. For example, a first group of antenna elements may be adapted to serve two communication services, such as discussed above with respect to a dual mode operation of antenna 400, while a second group of antenna elements is interspersed therewith for use with a third communication service. Similarly, three groups of antenna elements may be interspersed, substantially as discussed above with respect to antenna 900, for use with three or more communication services. The number of antenna element groupings utilized to provide multiple mode communications according to the present invention is limited only by the elemental density and the limits to which resulting mutual coupling can be compensated for.

Although preferred embodiments of the present invention have been discussed herein with reference to planar arrays, it should be appreciated that the concepts of the present invention are applicable to various other antenna configurations. For example, antennas of the present invention may be formed of curvilinear antenna structures, such as the cylindrical antenna systems shown and described in the above referenced application entitled "System and Method for Per Beam Elevation Scanning."

It shall be appreciated that, although primarily described above with reference to transmitting, i.e., a forward link signal, and the use of "inputs" and "outputs" of beam forming matrixes, the present invention is suitable for use in both the forward and reverse links. Accordingly, the antenna beams described above may define an area of reception rather than radiation and, thus, the interfaces of the beam forming matrixes described above as inputs and outputs may be reversed to be outputs and inputs respectively.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of providing a multiple mode antenna system, said method comprising:

selecting first desired operating attributes, including a first angle and a first beam width, of a first antenna beam associated with a first mode of said multiple modes;

selecting second desired operating attributes, including a second angle and a second beam width, of a second antenna beam associated with a second mode of said multiple modes;

deploying a first number of antenna elements in a first predetermined configuration, wherein a first inter-element spacing of said first predetermined configuration is compressed as compared to a corresponding typical phased array configuration of said first number of antenna elements, and wherein said first inter-element spacing is selected at least in part to provide an antenna beam substantially meeting said first desired operating attributes using a first beam former consistent with said corresponding typical phased array configuration of said first number of antenna elements; and deploying a second number of antenna elements in a second predetermined configuration, wherein a second inter-element spacing of said second predetermined configuration is selected at least in part to provide an antenna beam substantially meeting said second desired operating attributes, and wherein ones of said second number of antenna elements are interspersed with ones of said first number of antenna elements.

2. The method of claim 1, wherein said second inter-element spacing of said second predetermined configuration is compressed as compared to a corresponding typical phased array configuration of said second number of antenna elements, and wherein said second inter-element spacing is selected at least in part to provide an antenna beam substantially meeting said second desired operating attributes using a second beam former consistent with said corresponding typical phased array configuration of said second number of antenna elements.

3. The method of claim 2, wherein said interspersed antenna elements include a plurality of antenna elements of said second number of antenna elements having said inter-element spacing disposed between antenna elements of said first number of antenna elements having said inter-element spacing.

4. The method of claim 3, wherein said second number of antenna elements includes a plurality of antenna elements disposed to provide a substantially uniform radiating environment with respect to antenna elements of said first number of antenna elements.

5. The method of claim 1, wherein said deploying said first number of antenna elements and said deploying said second number of antenna elements comprise:

deploying said first number of antenna elements and said second number of antenna elements in a same plane.

6. The method of claim 5, further comprising:

deploying a ground plane, wherein said plane is parallel to said ground plane.

7. The method of claim 6, wherein said plane is spaced from a surface of said ground plane a function of the greater of a first carrier frequency wavelength associated with said first mode and a second carrier frequency wavelength associated with said second mode.

8. The method of claim 7, wherein said function is a predetermined fraction of said greater wavelength.

9. The method of claim 8, wherein said predetermined fraction is approximately ¼ of said greater wavelength.

10. The method of claim 8, wherein each of said first number of antenna elements and said second number of antenna elements are disposed a same function of said respective one of said first carrier frequency wavelength and said second carrier frequency wavelength from a ground surface.

11. The method of claim 10, further comprising:

adapting said ground plane to provide ground surfaces corresponding to a difference in said first carrier frequency wavelength and said second carrier frequency wavelength to thereby provide said ground surface disposed said same function of said first carrier frequency wavelength and said second carrier frequency wavelength from respective ones of said first number of antenna elements and said second number of antenna elements deployed in said plane.

12. The method of claim 11, wherein said adapting said ground plane comprises:

providing fin structures corresponding to antenna elements of one of said first number of antenna elements and said second number of antenna elements.

13. The method of claim 1, wherein one of said first and second modes of said multiple modes is associated with a cellular telephony communication system and wherein the other one of said first and second modes of said multiple modes is associated with a personal communication services system.

14. The method of claim 1, wherein said first predetermined configuration includes a plurality of columns of antenna elements of said first number of antenna elements, and wherein said second predetermined configuration includes a plurality of columns of antenna elements of said second number of antenna elements.

15. The method of claim 14, wherein said first inter-element spacing is a spacing between said columns of said first predetermined configuration to thereby provide a first inter-column spacing, and wherein said second inter-element spacing is a spacing between said columns of said second predetermined configuration to thereby provide a second inter-column spacing.

16. The method of claim 15, wherein said first inter-column spacing is from approximately 0.25 to 0.35 of a first carrier frequency wavelength associated with said first mode, and wherein said second inter-column spacing is from approximately 0.25 to 0.35 of a second carrier frequency wavelength associated with said second mode.

17. The method of claim 1, further comprising:

coupling said first beam former to said first number of antenna elements, wherein said first beam former is configured to provide antenna beams substantially more narrow than said first beam width; and using said first beam former to provide an antenna beam having said first angle and said first beam width.

18. The method of claim 1, further comprising:

adapting said antenna system to mitigate mutual coupling between antenna elements of said antenna system.

19. The method of claim 18, wherein said adapting said antenna system comprises:

deploying a Faraday fence between antenna elements of different columns of antenna elements.

20. The method of claim 18, wherein said adapting said antenna system comprises:

deploying a Faraday fence between antenna elements of a column of antenna elements.

21. The method of claim 18, wherein said adapting said antenna system comprises:

stagger tuning antenna elements of said antenna system.

22. The method of claim 18, wherein said adapting said antenna system comprises:

matching an impedance of antenna elements of said antenna system to a characteristic impedance of a beam forming network used therewith.

23. A multiple mode antenna system comprising:

means for deploying a first number of antenna elements in a first predetermined configuration, wherein a first inter-element spacing of said first predetermined configuration is compressed as compared to a corresponding typical phased array configuration of said first number of antenna elements, and wherein said first inter-element spacing is selected at least in part to provide an antenna beam substantially meeting first desired operating attributes using a first beam former consistent with said corresponding typical phased array configuration of said first number of antenna elements, wherein said first desired operating attributes include a first angle and a first beam width of a first antenna beam associated with a first mode of said multiple modes; and means for deploying a second number of antenna elements in a second predetermined configuration, wherein a second inter-element spacing of said second predetermined configuration is selected at least in part to provide an antenna beam substantially meeting a second desired operating attributes, and wherein ones of said second number of antenna elements are interspersed with ones of said first number of antenna elements, wherein said selecting second desired operating attributes include a second angle and a second beam width of a second antenna beam associated with a second mode of said multiple modes.

24. The system of claim 23, wherein said second inter-element spacing of said second predetermined configuration is compressed as compared to a corresponding typical phased array configuration of said second number of antenna elements, and wherein said second inter-element spacing is selected at least in part to provide an antenna beam substantially meeting said second desired operating attributes using a second beam former consistent with said corresponding typical phased array configuration of said second number of antenna elements.

25. The system of claim 24, wherein said interspersed antenna elements include a plurality of antenna elements of said second number of antenna elements having said inter-element spacing disposed between antenna elements of said first number of antenna elements having said inter-element spacing.

26. The system of claim 25, wherein said second number of antenna elements includes a plurality of antenna elements disposed to provide a substantially uniform radiation environment with respect to antenna elements of said first number of antenna elements.

27. The system of claim 23, wherein said means for deploying said first number of antenna elements and said means for deploying said second number of antenna elements comprise:

means for deploying said first number of antenna elements and said second number of antenna elements in a same plane.

28. The system of claim 27, further comprising:

means for deploying a ground plane, wherein said plane is parallel to said ground plane.

29. The system of claim 28, wherein said plane is a function of the greater of a first carrier frequency wavelength associated with said first mode and a second carrier frequency wavelength associated with said second mode from said ground plane.

30. The system of claim 29, wherein said function of said greater wavelength is a predetermined fraction of said greater wavelength.

31. The system of claim 30, wherein said fraction is approximately ¼.

32. The system of claim 29, wherein each of said first number of antenna elements and said second number of antenna elements are disposed a function of said respective one of said first carrier frequency wavelength and said second carrier frequency wavelength from a ground surface.

33. The system of claim 29, further comprising:

means for providing ground surfaces of said ground plane corresponding to a difference in said first carrier frequency wavelength and said second carrier frequency wavelength to thereby provide said ground surface disposed approximately ¼ of said first carrier frequency wavelength and said second carrier frequency wavelength from respective ones of said first number of antenna elements and said second number of antenna elements deployed in said plane.

34. The system of claim 23, wherein said first predetermined configuration includes a plurality of columns of antenna elements of said first number of antenna elements, and wherein said second predetermined configuration includes a plurality of columns of antenna elements of said second number of antenna elements.

35. The system of claim 34, wherein said first predetermined configuration includes eight columns and said second predetermined configuration includes fourteen columns.

36. The system of claim 34, wherein said first inter-element spacing is a spacing between said columns of said first predetermined configuration to thereby provide a first inter-column spacing, and wherein said second inter-element spacing is a spacing between said columns of said second predetermined configuration to thereby provide a second inter-column spacing.

37. The system of claim 36, wherein said first inter-column spacing is from approximately 0.25 to 0.35 of a first carrier frequency wavelength associated with said first mode, and wherein said second inter-column spacing is from approximately 0.25 to 0.35 of a second carrier frequency wavelength associated with said second mode.

38. The system of claim 23, further comprising:

means for forming beams coupled to said first number of antenna elements, wherein said first means for beam forming is configured to provide antenna beams substantially more narrow than said first beam width; and means for using said first beam former to provide an antenna beam having said first angle and said first beam width.

39. The system of claim 23, further comprising:

a Faraday fence disposed between antenna elements of different columns of antenna elements.

40. The system of claim 23, further comprising:

a Faraday fence between antenna elements of a column of antenna elements.

41. A multiple mode antenna system comprising:

first beam forming circuitry having at least one A interface associated with a first antenna beam and a plurality of B interfaces having a plurality of phase progressions associated therewith, wherein said first antenna beam is associated with a first mode of said multiple modes;

second beam forming circuitry having at least one A interface associated with a second antenna beam and a plurality of B interfaces having a plurality of phase progressions associated therewith, wherein said second antenna beam is associated with a second mode of said multiple modes;

a first plurality of antenna elements ones of which are coupled to one of said B interfaces of said first beam forming circuitry, wherein said plurality of phase progressions are consistent with forming antenna beams more narrow than said first antenna beam, and wherein each of the first plurality of antenna elements which are coupled to different ones of said B interfaces of said first beam forming circuitry are spaced a first distance, from a next adjacent one of the first plurality of antenna elements which are coupled to different ones of said B interfaces, determined to provide said first antenna beam with a desired beam width using said first phase progression; and a second plurality of antenna elements ones of which are coupled to one of said B interfaces of said second beam forming circuitry, wherein ones of said second plurality of antenna elements are interspersed with ones of said first plurality of antenna elements.

42. The system of claim 41, wherein said plurality of phase progressions are consistent with forming antenna beams more narrow than said second antenna beam, and wherein each of the second plurality of antenna elements which are coupled to different ones of said B interfaces of said second beam forming circuitry are spaced a second distance, from a next adjacent one of the second plurality of antenna elements which are coupled to different ones of said B interfaces, determined to provide said second antenna beam with a desired beam width using said first phase progression.

43. The system of claim 42, wherein said interspersed antenna elements include a plurality of columns of antenna elements of said second plurality of antenna elements disposed between antenna element columns of said first plurality of antenna elements.

44. The system of claim 43, wherein said first distance is a spacing between said columns of said first plurality of antenna elements and said second distance is a spacing between said columns of said second plurality of antenna elements.

45. The system of claim 44, wherein said first distance is from approximately 0.25 to 0.35 of a first carrier frequency wavelength associated with said first mode, and wherein said second distance is from approximately 0.25 to 0.35 of a second carrier frequency wavelength associated with said second mode.

46. The system of claim 41, wherein at least one of said first plurality of antenna elements and said second plurality of antenna elements includes a plurality of antenna elements disposed to provide a substantially uniform radiating environment with respect to antenna elements of the other one of said first plurality of antenna elements and said second plurality of antenna elements.

47. The system of claim 46, wherein said plurality of antenna elements disposed to provide a substantially uniform radiating environment are passive antenna elements.

48. The system of claim 46, further comprising:

third beam forming circuitry, wherein said plurality of antenna elements disposed to provide a substantially uniform radiating environment are coupled to said third beam forming circuitry.

49. The system of claim 41, wherein said first plurality of antenna elements and second plurality of antenna elements are disposed in a same plane.

50. The system of claim 49, further comprising:

a ground plane, wherein said plane is parallel to said ground plane.

51. The system of claim 50, wherein said plane is approximately ¼ of the greater of a first carrier frequency wavelength associated with said first mode and a second carrier frequency wavelength associated with said second mode from said ground plane.

52. The system of claim 51, wherein each of said first plurality of antenna elements and said second plurality of antenna elements are disposed approximately ¼ of said respective one of said first carrier frequency wavelength and said second carrier frequency wavelength from a ground surface.

53. The system of claim 52, further comprising:

adapting said ground plane to provide ground surfaces corresponding to a difference in said first carrier frequency wavelength and said second carrier frequency wavelength to thereby provide said ground surface disposed approximately ¼ of said first carrier frequency wavelength and said second carrier frequency wavelength from respective ones of said first plurality of antenna elements and said second plurality of antenna elements deployed in said plane.

54. The system of claim 53, wherein said adapting said ground plane comprises:

providing fin structures corresponding to antenna elements of one of said first plurality of antenna elements and said second plurality of antenna elements.

55. An antenna system comprising:

a plurality of antenna elements disposed in a plane to thereby present an element plane, wherein a first group of antenna elements of said plurality of antenna elements are adapted for use with a first frequency band and a second group of antenna elements of said plurality of antenna elements are adapted for use with a second frequency band, wherein said first frequency band and said second frequency band are different; and a ground plane having a surface corresponding to said element plane, wherein said surface of said ground plane is adapted to present ground surfaces a first predetermined distance from antenna elements of said first group and a second predetermined distance from antenna elements of said second group, wherein said first distance and said second distance are different.

56. The system of claim 55, wherein said first frequency band is a cellular telephone frequency band and said second frequency band is a personal communication services frequency band.

57. The system of claim 55, wherein said first frequency band is in the range of approximately 800 MHz and said second frequency band is in the range of 1.8 GHz.

58. The system of claim 55, wherein said first frequency band and said second frequency band are different by at least 500 MHz.

59. The system of claim 55, further comprising:

a first beam forming network coupled to antenna elements of said first group of antenna elements and providing weighting to signals of said first group of antenna elements, wherein said signal weighting is consistent with forming antenna beams more narrow than that to be formed with said first frequency band, and wherein a spacing of antenna elements of said first group of antenna elements is determined to provide a desired beam width using said signal weighting.

60. The system of claim 55, wherein said first group of antenna elements includes antenna elements which are not coupled to said first beam forming network utilized to provide a substantially uniform radiation environment.

61. The system of claim 59, wherein said signal weighting comprises a desired phase relationship.

62. The system of claim 59, wherein said signal weighting comprises a desired amplitude relationship.

63. The system of claim 59, further comprising:

a second beam forming network coupled to antenna elements of said second group of antenna elements and providing weighting to signals of said second group of antenna elements, wherein said signal weighting is consistent with forming antenna beams more narrow than that to be formed with said second frequency band, and wherein a spacing of antenna elements of said second group of antenna elements is determined to provide a desired beam width using said signal weighting.

64. The system of claim 55, wherein adaptation of said ground plane comprises:

a plurality of raised portions corresponding to antenna elements of one of said first group of antenna elements and said second group of antenna elements.

65. The system of claim 64, wherein said raised portions comprise ground surface fin members.

66. The system of claim 64, wherein said first distance is approximately ½ of a mid-band wavelength of said first frequency band and said second distance is approximately ½ of a mid-band wavelength of said second frequency band.

67. A method for providing a dual mode antenna system, said method comprising:

disposing a first plurality of antenna element columns in a plane a predetermined distance from a ground plane, wherein said first plurality of antenna element columns have a substantially consistent first inter-column spacing;

coupling a first beam forming circuit to ones of said first plurality of antenna element columns, wherein said first beam forming circuit provides antenna signal weighting consistent with inter-column spacing greater than said first inter-column spacing;

disposing a second plurality of antenna element columns in said plane said predetermined distance from said ground plane, wherein said second plurality of antenna element columns have a substantially consistent second inter-column spacing, wherein said second inter-column spacing is less than ½ said first inter-column spacing, and wherein said second plurality of antenna element columns are interspersed with said first plurality of antenna element columns such that at least two columns of said second plurality of antenna element columns are disposed between adjacent pairs of said first plurality of antenna element columns; and coupling a second beam forming circuit to ones of said second plurality of antenna element columns, wherein said second beam forming circuit provides antenna signal weighting consistent with inter-column spacing greater than said second inter-column spacing.

68. The method of claim 67, wherein said first plurality of antenna element columns is eight antenna element columns and said second plurality of antenna element columns is fourteen antenna element columns.

69. The method of claim 67, wherein ones of said second plurality of antenna element columns are not coupled to said second beam forming circuit to provide a substantially uniform radiation environment with respect to ones of said first plurality of antenna element columns.

70. The method of claim 67, wherein said first inter-column spacing is approximately 0.25 to 0.35 the wavelength of a frequency said first plurality of antenna element columns are to be operated at.

71. The method of claim 67, wherein said second inter-column spacing is approximately 0.25 to 0.35 the wavelength of a frequency said second plurality of antenna element columns are to be operated at.

72. The method of claim 67, further comprising:

adapting said ground plane to present a ground surface approximately ½ the wavelength of a first frequency said first plurality of antenna element columns are to be operated at from said first plurality of antenna element columns and approximately ½ the wavelength of a second frequency said second plurality of antenna element columns are to be operated at from said second plurality of antenna element columns, wherein said first frequency and said second frequency are different.

* * * * *

UNITED STATES PATENT AND TRADEMARK OFFICE

CERTIFICATE OF CORRECTION

PATENT NO. : 6,583,760 B2
DATED : June 24, 2003
INVENTOR(S) : Gary A. Martek

It is certified that error appears in the above-identified patent and that said Letters Patent is hereby corrected as shown below:

Column 3,
Line 30, delete "outputs=2," and insert -- outputs=$2^n$ --

Column 4,
Lines 4 and 20, delete "1200" and insert -- 120º --
Line 7, delete "150" and insert -- 15º --

Column 8,
Line 11, delete "b.," and insert -- $b_{e1}$ --
Line 23, delete "$^1/_3\Delta A$," and insert -- $^1/_3\Delta$, --

Column 11,
Line 5, delete " x8" and insert -- 8x8 --

Column 14,
Line 51, delete "$a_{e9-2}$" and insert -- $a_{e9-1}$ --

Column 15,
Line 1, delete "$h_{9-1}$" and insert -- $h_{e9-1}$ --
Line 66, delete "101-1014" and insert -- 1011-1014 --

Signed and Sealed this

Fourth Day of November, 2003

JAMES E. ROGAN
*Director of the United States Patent and Trademark Office*